US012342977B2

(12) United States Patent
Yamada et al.

(10) Patent No.: US 12,342,977 B2
(45) Date of Patent: Jul. 1, 2025

(54) CLEANER SHEET, LAYERED BODY OF CLEANER SHEET, CLEANING TOOL, AND METHOD FOR PRODUCING CLEANER SHEET

(71) Applicants: NITOMS, INC., Tokyo (JP); NITTO DENKO CORPORATION, Ibaraki (JP)

(72) Inventors: Hirofumi Yamada, Tokyo (JP); Hiroshi Nagami, Tokyo (JP); Yosuke Suyama, Tokyo (JP); Tsuneaki Omori, Tokyo (JP); Yoshitake Shigematsu, Tokyo (JP); Yoji Ebisu, Tokyo (JP); Teiji Sakashita, Tokyo (JP); Mao Suzukawa, Tokyo (JP)

(73) Assignees: NITOMS, INC., Tokyo (JP); NITTO DENKO CORPORATION, Ibaraki (JP)

( * ) Notice: Subject to any disclaimer, the term of this patent is extended or adjusted under 35 U.S.C. 154(b) by 0 days.

(21) Appl. No.: 17/860,155

(22) Filed: Jul. 8, 2022

(65) Prior Publication Data

US 2022/0346625 A1 Nov. 3, 2022

Related U.S. Application Data

(63) Continuation of application No. 17/293,983, filed as application No. PCT/JP2020/037943 on Oct. 7, 2020, now Pat. No. 11,412,916.

(30) Foreign Application Priority Data

Oct. 8, 2019 (JP) ..... 2019-185486
Oct. 8, 2019 (JP) ..... 2019-185487
(Continued)

(51) Int. Cl.
*A47L 25/00* (2006.01)
*A47L 13/16* (2006.01)

(52) U.S. Cl.
CPC ..... *A47L 25/005* (2013.01); *A47L 13/16* (2013.01); *Y10T 428/24802* (2015.01); *Y10T 428/24893* (2015.01)

(58) Field of Classification Search
CPC ..... A47L 13/16
See application file for complete search history.

(56) References Cited

U.S. PATENT DOCUMENTS 4,111,666 A 9/1978 Kalbow
4,158,553 A 6/1979 Chapman
(Continued)

FOREIGN PATENT DOCUMENTS

JP 8-196504 A 8/1996
JP 09-220191 A 8/1997
(Continued)

OTHER PUBLICATIONS

Extended European Search Report issued Jul. 27, 2023 in European Application No. 20873564.7.
(Continued)

*Primary Examiner* — Ian A Rummel
(74) *Attorney, Agent, or Firm* — Sughrue Mion, PLLC

(57) ABSTRACT

Provided is, for example, a cleaner sheet including: a cleaning surface that is configured to be brought into sliding contact with a surface of an object to be cleaned. The cleaning surface has unevenness, and includes projections respectively having distal ends configured to be in sliding contact with the object to be cleaned when in use. The projections are constituted by a member formed to have the projections arranged at intervals from each other in a plane direction of the cleaning surface. The member has a hard-
(Continued)

ness of 0.4 MPa or more measured by a nano-indentation method. The cleaning surface further includes adhesive recesses that have higher adhesive force than that of the member and are exposed on the cleaning surface.

18 Claims, 9 Drawing Sheets

(30) Foreign Application Priority Data

Oct. 5, 2020 (JP) ..... 2020-168613
Oct. 5, 2020 (JP) ..... 2020-168636

(56) References Cited

U.S. PATENT DOCUMENTS

| | | | |
|---|---|---|---|
| 7,386,907 | B2 | 6/2008 | Otsuka et al. |
| 2003/0124935 | A1 | 7/2003 | Smith et al. |
| 2007/0130713 | A1 | 6/2007 | Chen et al. |
| 2008/0216260 | A1 | 9/2008 | Silverman |
| 2009/0276971 | A1 | 11/2009 | Nozari |
| 2014/0283323 | A1 | 9/2014 | Tuman et al. |
| 2018/0028037 | A1 | 2/2018 | Daveloose et al. |
| 2018/0035867 | A1 | 2/2018 | Kakita et al. |

FOREIGN PATENT DOCUMENTS

| | | | |
|---|---|---|---|
| JP | 11-313792 | A | 11/1999 |
| JP | 2007-117534 | A | 5/2007 |
| JP | 2009-148601 | A | 7/2009 |
| JP | 2011-62401 | A | 3/2011 |
| JP | 2017-118976 | A | 7/2017 |
| JP | 2018-083090 | A | 5/2018 |
| KR | 10-2014-0092382 | A | 7/2014 |
| KR | 10-2017-0125861 | A | 11/2017 |
| WO | 2009/113248 | A1 | 9/2009 |
| WO | 2016/137707 | A1 | 9/2016 |
| WO | 2017/110316 | A1 | 6/2017 |

OTHER PUBLICATIONS

Written Opinion for PCT/JP2020/037943 dated Dec. 15, 2020 [PCT/ISA/237].
International Preliminary Report on Patentability with the translation of Written Opinion dated Apr. 21, 2022 from the International Bureau for PCT/JP2020/037943.
International Search Report for PCT/JP2020/037943 dated Dec. 15, 2020 [PCT/ISA/210].
Office Action issued Sep. 21, 2023 in Taiwanese Application No. 109134717.
Notice of Reasons for Refusal dated Jun. 7, 2024 issued by the Japanese Patent Office in application No. 2020-168636.
Korean Office Action issued in KR Appln No. 2022-7014937 dated Jan. 31, 2025.
Extended European Search Report issued in EP Appln No. 24211422.1 dated Feb. 12, 2025.

CLEANER SHEET, LAYERED BODY OF CLEANER SHEET, CLEANING TOOL, AND METHOD FOR PRODUCING CLEANER SHEET

CROSS-REFERENCE TO RELATED APPLICATIONS

This is a continuation of application Ser. No. 17/293,983 filed May 14, 2021, which is a National Stage of International Application No. PCT/JP2020/037943 filed Oct. 7, 2020, claiming Japanese Patent Application Nos. 2019-185486, filed Oct. 8, 2019, 2019-185487, filed Oct. 8, 2019, 2020-168613, filed Oct. 5, 2020, and 2020-168636, filed Oct. 5, 2020, the disclosures of which are incorporated herein by reference in their entirety.

FIELD

The present invention relates to a cleaner sheet, a layered body of the cleaner sheet, a cleaning tool, and a method for producing the cleaner sheet.

BACKGROUND

Various cleaning tools (wiping tools) for cleaning floor surfaces such as flooring are widely known. A cleaning tool of this type includes, for example, a head attached to an end of a rod-shaped handle, and a cleaner sheet detachably attached to the head, and is used with the cleaner sheet fixed to the head (Patent Literature 1). The cleaning tool disclosed in Patent Literature 1 is configured to be able to capture dust or dirt (i.e., objects to be removed) on an object to be cleaned by bringing one side (i.e., a cleaning surface) of the cleaner sheet into sliding contact with a surface of the object to be cleaned such as a floor.

CITATION LIST

Patent Literature

Patent Literature 1: JP H9-220191 A

SUMMARY

Technical Problem

The cleaner sheet fixed to the cleaning tool for use, which is disclosed in Patent Literature 1, includes a fiber sheet in which fibers are assembled. Specifically, the cleaner sheet disclosed in Patent Literature 1 includes an outermost fiber sheet through which a plurality of holes penetrate in a thickness direction, and an adhesive layer superposed on the fiber sheet. The cleaner sheet disclosed in Patent Literature 1 can take advantage of the fine fiber structure of the fiber sheet to scrape and capture dust or dirt. Dust or dirt that comes into the holes can be captured by a surface of the adhesive layer with its adhesive force, and can be kept captured by the surface. The cleaner sheet disclosed in Patent Literature 1 has a certain degree of slidability. However, no sufficient consideration has been necessarily given on a cleaner sheet having good slidability, and a cleaner sheet with good slidability has been demanded.

In view of the abovementioned demand or the like, it is an object of the present invention to provide a cleaner sheet satisfying good slidability, a layered body of the cleaner sheet, and a cleaning tool including the cleaner sheet. It is also an object to provide a method for producing the cleaner sheet.

Solution to Problem

The cleaner sheet according to the present invention is a cleaner sheet including: a cleaning surface that is configured to be brought into sliding contact with a surface of an object to be cleaned, wherein the cleaning surface has unevenness, and includes projections respectively having distal ends configured to be in sliding contact with the object to be cleaned when in use, the projections are constituted by a member formed to have the projections arranged at intervals from each other in a plane direction of the cleaning surface, the member has a hardness of 0.4 MPa or more measured by the nano-indentation method, and the cleaning surface further includes adhesive recesses that have higher adhesive force than that of the member and are exposed on the cleaning surface.

The method for producing the cleaner sheet according to the present invention is a method for producing the above cleaner sheet, the method including: forming the member of the projections by coating.

The layered body of the present invention is composed of the above cleaner sheet in a state of being wound onto itself, or a plurality of the above cleaner sheets in a state of being laid on top of each other in a thickness direction.

The cleaning tool of the present invention includes: the above cleaner sheet; and a sheet fixing part to which the cleaner sheet is detachably attached.

DESCRIPTION OF EMBODIMENTS

A detailed description will be hereinafter given on an embodiment of a cleaner sheet and a cleaning tool according to the present invention, with reference to the drawings.

<Cleaning Tool>

Figure 3:
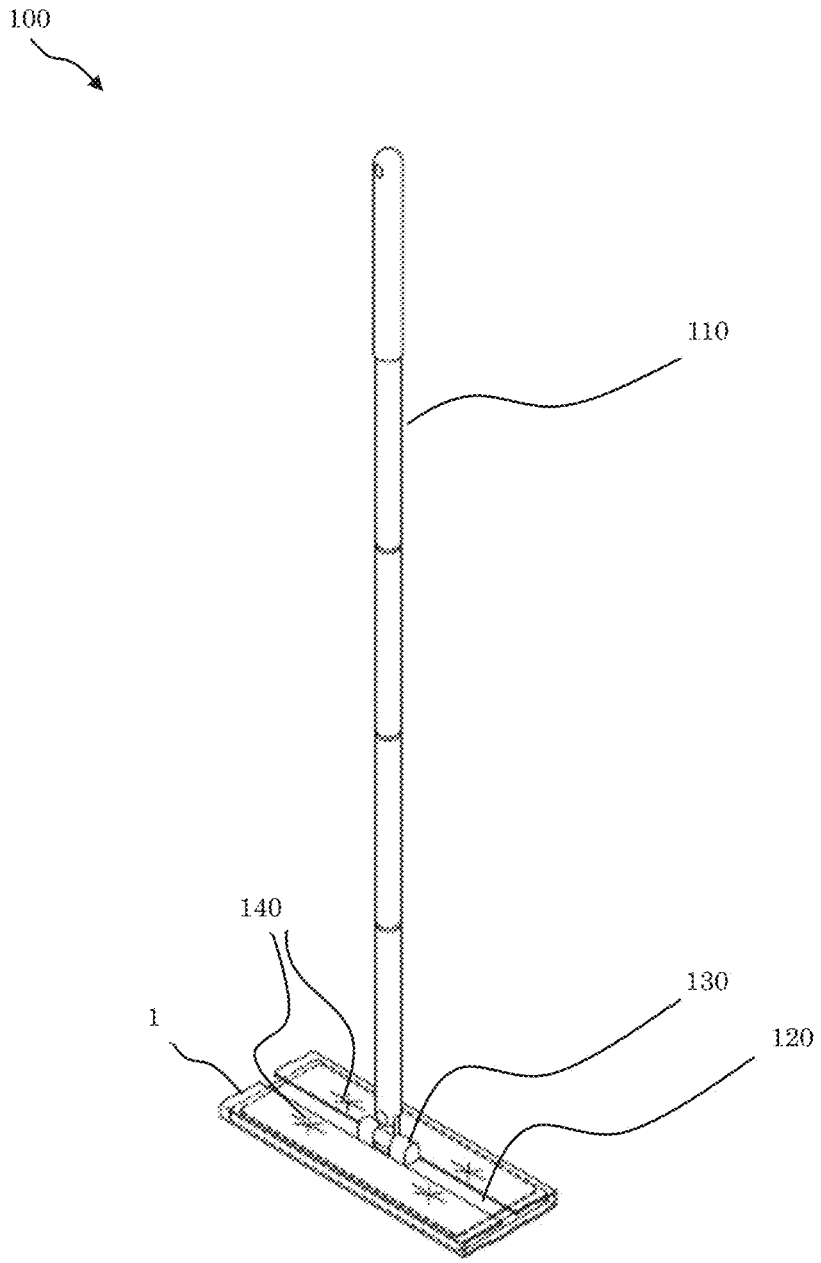
FIG. 3 is a perspective view showing a schematic configuration of a cleaning tool to which a cleaner sheet according to one embodiment is attached.

As shown in FIG. 3, a cleaning tool 100 of this embodiment includes a cleaner sheet 1, which will be described in detail later, and a sheet fixing part 120 to which the cleaner sheet 1 is fixed. The cleaning tool 100 of this embodiment further includes a rod-shaped gripping member 110 serving as a handle. The sheet fixing part 120 has a flat plate shape to keep a cleaning surface 10 of the cleaner sheet 1 in a flat shape, and is pivotally connected to an end of the gripping member 110 via a universal joint 130. In this embodiment, the sheet fixing part 120 has a flat plate shape, and has a rectangular shape as seen from one side in a thickness direction. The sheet fixing part 120 is configured to allow at least a part of the cleaning surface 10 of the cleaner sheet 1 fixed thereto to be brought into contact by an operator with a surface of an object to be cleaned, and to slide thereon to any direction in a plane direction.

The cleaner sheet 1 of this embodiment is attached to the sheet fixing part 120 in, for example, the following way. Specifically, one side of the cleaner sheet 1 includes the cleaning surface 10 to be in sliding contact with the object to be cleaned, and a non-cleaning surface 20 not to be in sliding contact. The cleaner sheet 1 is superposed on one side of the sheet fixing part 120 (i.e., a flat surface that faces the object to be cleaned when in use) so as to have the cleaning surface 10 of the cleaner sheet 1 facing outside. The cleaner sheet 1 is folded along edges of the opposed long sides of the sheet fixing part 120 to fix portions of the cleaner sheet 1 constituting the non-cleaning surfaces 20 to the other side of the sheet fixing part 120 (i.e., a side not facing the object to be cleaned). In this embodiment, the other side of the sheet fixing part 120 has flexible members on which radial slits 140 are respectively formed. The cleaner sheet 1 can be detachably fixed to the sheet fixing part 120 by pushing the portions of the cleaner sheet 1 constituting the non-cleaning surfaces 20 into the radial slits 140. Thus, the cleaner sheet 1 is detachably attached to the sheet fixing part 120. A fixing device is not limited thereto, and known fixing devices such as a clip can also be employed. The cleaner sheet 1 may be attached to the sheet fixing part 120 using, for example, double-sided tape. The configuration may be such that an adhesive layer is superposed on a part or the whole of the rear surface of the cleaner sheet 1, and is bonded to the sheet fixing part 120. Only one cleaner sheet 1 may be fixed to the sheet fixing part 120, or a plurality of cleaner sheets 1 that are laid on top of each other may be fixed to the sheet fixing part 120. The cleaner sheet 1 that has been damaged or become dirty by use can be easily removed from the sheet fixing part 120 when replacement is needed. Then, the used cleaner sheet 1 is replaced by a new, unused cleaner sheet. In the case where the plurality of cleaner sheets 1 that are laid on top of each other are fixed to the sheet fixing part 120, the outermost cleaner sheet 1 that has become dirty is removed along, for example, perforation to enable a clean cleaner sheet 1 to be exposed. In the aforementioned cleaning tool, the cleaner sheet 1 is detachably attached to the sheet fixing part 120. When the operator handles the sheet fixing part 120 in such a manner as in a mop or a flooring wiper during cleaning, the cleaner sheet 1 attached to the sheet fixing part 120 can be brought into sliding contact with the surface of the object to be cleaned for efficient cleaning operation.

A more detailed description will be given on the cleaner sheet 1 of this embodiment with reference to the drawings.

<Cleaner Sheet>

Figure 1:
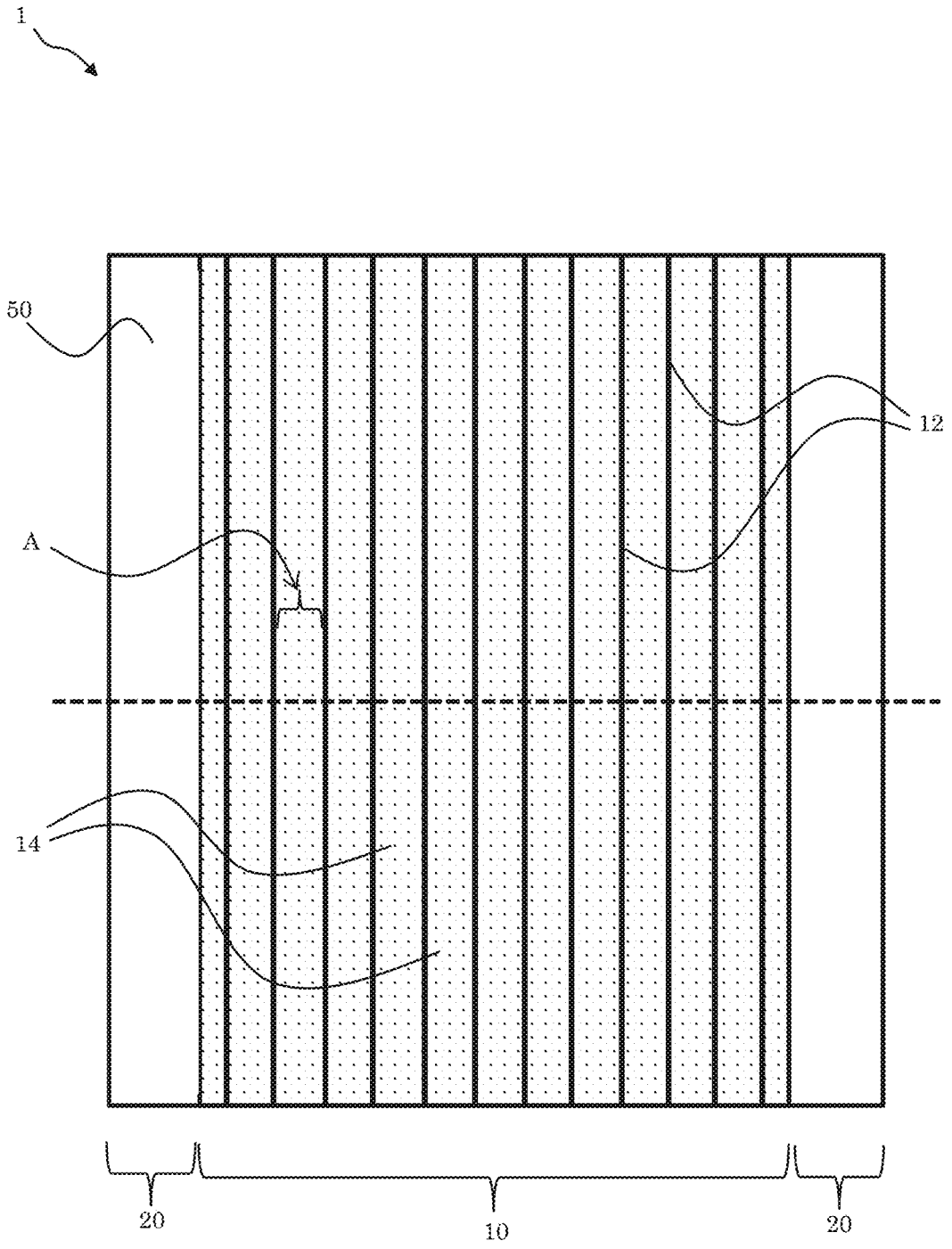
FIG. 1 is a schematic view of a cleaner sheet according to one embodiment as seen from one side (i.e., a cleaning surface side).
Figure 2A:
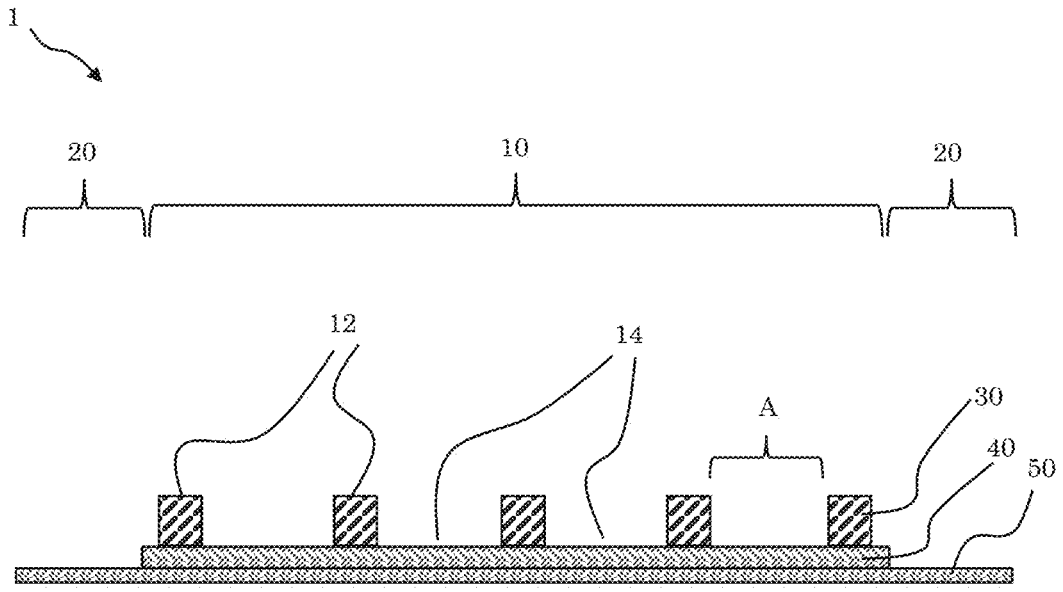
FIG. 2A is a schematic cross-sectional view of a cleaner sheet according to one embodiment taken in a thickness direction along dashed line in FIG. 1.

As shown in FIG. 1 and FIG. 2A, the cleaner sheet 1 of this embodiment has a relatively small thickness. The cleaner sheet 1 of this embodiment includes the cleaning surface 10 that is brought into sliding contact with the object to be cleaned. The cleaning surface 10 has unevenness, and includes projections 12 respectively having distal ends configured to be in sliding contact with the object to be cleaned when in use. The projections 12 are constituted by a member 30 formed to have the projections arranged at intervals A in the plane direction of the cleaning surface 10. The hardness of the member 30 measured by the nano-indentation method is 0.4 MPa or more. The cleaning surface 10 further includes adhesive recesses 14 that have higher adhesive force than that of the member 30 and are exposed on the cleaning surface 10. Specifically, the cleaner sheet 1 of this embodiment includes the cleaning surface 10 that is brought into sliding contact with the object to be cleaned. The cleaning surface 10 has an uneven shape. The cleaner sheet 1 of this embodiment includes an adhesive layer 40 constituting at least a part of the bottom portions of recesses, and the projection constituting member 30 constituting projections and having lower adhesive force than that of the adhesive layer 40. The projection constituting member 30 is formed to have the projections arranged at intervals in at least one direction among the plane direction of the cleaning surface 10, and is configured to have the recesses formed (arranged) respectively between the projections. In the cleaner sheet 1 of this embodiment, the projection constituting member 30 is arranged to protrude from the adhesive layer 40 to thereby form the projections 12 on the cleaning surface 10. The adhesive recesses 14 are formed with at least a part of the adhesive layer 40 arranged on the bottom portions of the recesses. In each of the adhesive recesses 14, at least a part of the adhesive layer 40 is exposed on the cleaning surface 10. The hardness of the projection constituting member 30 measured by the nano-indentation method is 0.4 MPa or more.

As shown in FIG. 2A, the cleaner sheet 1 of this embodiment includes the member 30 that is brought into sliding contact with the object to be cleaned, a support base 50, and the adhesive layer 40 arranged between the member 30 and the support base 50. In other words, the cleaner sheet 1 of this embodiment includes the support base 50 that faces the gripping member 110 when the cleaner sheet 1 is fixed to the cleaning tool 100, the adhesive layer 40 superposed on a part of the surface of the support base 50, and the member 30 superposed on a part of the surface of the adhesive layer 40. More specifically, the adhesive layer 40 is arranged to cover at least a central portion on one side of the support base 50, and the member 30 is arranged to be superposed on one side of the adhesive layer 40 (i.e., a side that faces the object to be cleaned). The number of elements constituted by the member 30 in FIG. 2A is smaller than in FIG. 1 for ease of viewing.

As shown in FIG. 1 and FIG. 2A, the cleaner sheet 1 of this embodiment has one side (i.e., a side facing outside when the cleaner sheet 1 is fixed to the sheet fixing portion 120) on which the cleaning surface 10 that is brought into sliding contact with the surface of the object to be cleaned, such as a floor, is formed. The cleaner sheet 1 may include the non-cleaning surface 20 as in this embodiment. In this embodiment, the cleaning surface 10 is constituted by the projections 12 and a part of the adhesive layer 40 (i.e., the adhesive recesses 14), while the non-cleaning surface 20 is constituted by the surface of the support base 50. The non-cleaning surface 20 may be constituted by one or a plurality of release layers arranged on the surface of the support base 50. As shown in FIG. 1, one cleaning surface 10 is arranged between two belt-shaped non-cleaning surfaces 20 opposed to each other when the rectangular cleaner sheet 1 is seen from one side. In other words, the cleaning surface 10 having a rectangular shape is arranged to be sandwiched between two belt-shaped non-cleaning surfaces 20. The cleaning surface 10 may be formed only on one side of the cleaner sheet 1 as aforementioned, or two cleaning surfaces 10 may be formed respectively on both sides thereof.

In this embodiment, the projection constituting member 30 is constituted by a plurality of line members (linear members). The cleaning surface 10 of the cleaner sheet 1 includes the projections 12 constituted by the member (projection constituting member 30) in which the plurality of line members are arranged at the intervals A in the plane direction. The cleaning surface 10 has the adhesive recesses 14 as aforementioned. In this embodiment, the projection constituting member 30 is constituted by the plurality of line members. The plurality of line members are arranged to be in contact with the surface of the adhesive layer 40. The plurality of line members are arranged at the intervals A along any one direction in the plane direction of the cleaning surface 10. The plurality of line members arranged in parallel with each other extend in a direction corresponding to the longitudinal direction of the belt-shaped non-cleaning surfaces 20. The adhesive layer 40 in the adhesive recesses 14 has higher adhesive force than that of the projection constituting member 30. At least a part of the adhesive layer 40 is exposed on the cleaning surface 10. In this embodiment, the adhesive recesses 14 are arranged respectively in the intervals A, and are recessed from the distal ends of the projections 12 to a depth corresponding to the projecting height of the projections 12. The bottom portions of the adhesive recesses 14 each have at least a part of the adhesive layer 40 exposed. The aforementioned configuration allows the adhesive layer 40 to have relatively high adhesive force, but since the adhesive recesses 14 are recessed from the distal ends of the projections 12, the cleaning surface 10 is less likely to be subjected to the influence of the frictional force caused by the adhesive force of the adhesive layer 40, and is made to slide on the surface of the object to be cleaned while the distal ends of the projections 12 are mainly in contact with the surface of the object to be cleaned. The cleaner sheet 1 thereby has good slidability. The aforementioned configuration causes the cleaner sheet 1 to be used mainly with the distal ends of the projections 12 being in sliding contact with the object to be cleaned. When in sliding contact, the cleaner sheet 1 can collect dust or dirt in the intervals A each present between each adjacent two line members. The adhesive recesses 14 that have relatively high adhesive force and are recessed as compared with the projections are arranged respectively in the intervals A; thus, the adhesive layer 40 of the adhesive recesses 14 can capture collected dust or dirt. Further, even when relatively heavy-weight dust or dirt is captured, it can still be retained on the surface of the adhesive recesses 14 by the adhesive force. Thus, the aforementioned cleaner sheet has good dust or dirt capturing capability.

The static friction coefficient of the cleaning surface (to a SUS304 plate) is preferably 3.00 or less, more preferably 1.50 or less, further preferably 1.00 or less. This configuration enables the cleaner sheet 1 to exert better slidability. The static friction coefficient may be 0.20 or more. The static friction coefficient is measured according to the measurement conditions stipulated in JIS K7125: 1999 (ISO8295: 1995), at a measurement temperature of 23° C. The dynamic friction coefficient can also be obtained in the same manner. In measuring the friction coefficient, a SUS steel plate (100×200 mm) used in JIS Z0237: 2009 is employed. On this SUS steel plate, a sheet having a size of 80×160 mm that has been cut out of the cleaner sheet is placed with its cleaning surface in contact with a surface of the SUS steel plate, and a sliding piece having a contact area of 40 $cm^2$ (a length of one side of 63 mm) is placed. The sliding piece is adjusted to have the total mass of 200 g. The friction coefficients are measured at a speed of 100 mm/min, and the static friction coefficient and the dynamic friction coefficient both caused by the maximum force within a measurement distance of 60 mm are calculated. The average values of five measurements each are recorded. An auxiliary plate is connected to a load cell through a spring at the time of measuring the static friction coefficient, and no spring is used in measuring the dynamic friction coefficient. The aforementioned static friction coefficient and dynamic friction coefficient can be made smaller by, for example, making larger a ratio (H/L) to be described later. The ratio (H/L) herein means a ratio (H/L) between the average projection height (H: mm) from a distal end of each of the projections 12 to each corresponding one of the adhesive recesses 14 and the average length (L: mm) of the adhesive recesses in a first direction in which the average length of the intervals in the plane direction of the cleaning surface becomes a minimum value.

(Projection Constituting Member)

In this embodiment, the projection constituting member 30 is constituted by the plurality of line members extending in parallel with each other. A part of the adhesive layer 40 is exposed in the intervals A respectively between each adjacent line members. With this configuration, dust or dirt collected by the sliding contact near the adhesive recesses 14 can be captured by the adhesive layer 40, and can be kept captured by the adhesive force of the adhesive recesses 14. Accordingly, good dust or dirt capturing capability is exerted.

The width of the line members is generally 0.01 mm or more. The width of the line members is more preferably 0.02 mm or more, further preferably 0.03 mm or more, particularly preferably 0.1 mm or more. The width of the line members may be 20 mm or less, may be 10 mm or less, may be 5 mm or less, may be 1 mm or less. It is preferable that the width of the line members fall within the above ranges in the case where the projections are constituted by a plurality of line members arranged in parallel with each other, or in the case where the projections are constituted by a plurality of line members crossing each other.

The hardness of the projection constituting member 30 is measured by the nano-indentation method. The hardness is 0.4 MPa or more. The hardness being 0.4 MPa or more enables the frictional force during the sliding contact to be relatively small between the surface of the object to be cleaned and the projections 12 being in sliding contact with the surface of the object to be cleaned. Thus, the cleaner sheet 1 having such a member with relatively large stiffness on the cleaning surface 10 has good slidability. Since the projections 12 are constituted by such a member with relatively large stiffness, the member can be suppressed from being worn by the sliding contact during cleaning to thereby enable the cleaner sheet 1 to exert good durability. The aforementioned hardness of the projection constituting member 30 is 0.4 MPa or more, preferably 1.5 MPa or more, more preferably 3.0 MPa or more, further preferably 5.0 MPa or more, particularly preferably 10.0 MPa or more. The upper limit of the aforementioned hardness of the member is not particularly limited, and the hardness of the members may be 200 MPa or less. The hardness of the member 30 is preferably 100 MPa or less, more preferably 70 MPa or less, particularly preferably 50 MPa in terms of imparting reasonable deformability to the members 30, and in terms of suppressing the projections 12 from making scratches on the surface of the object to be cleaned.

The hardness of the member 30 by the nano-indentation method is measured according to ISO14577. Specifically, it is measured with a measuring instrument "TI950 TriboIndenter" (manufactured by Hysitron). More specifically, it is calculated by dividing the "load when an indenter is pushed deepest (maximum load Pmax)" by the "area in which the indenter and a measurement sample are in contact with each other (contact projected area B)". As the indenter, a Berkovich type diamond indenter (a trigonal pyramid-type indenter) is used, and single pushing measurement is performed. The thickness of the member 30 at the time of the measurement is desirably at least 50 μm in order to have a measured value affected only by the member 30. The pushing speed of the indenter is 500 nm/sec, and the drawing speed thereof is 500 nm/sec. The pushing depth of the indenter is 5 μm. The measurement is performed at 25° C. The measurement is performed at least three times to obtain an average value. The measurement in the same manner is performed in Examples described later.

The elastic modulus of the member 30 by the nano-indentation method may be 4.5 MPa or more and 1000 MPa or less, may be 4.5 MPa or more and 500 MPa or less, may be 4.5 MPa or more and 200 MPa or less. The elastic modulus is calculated based on the result of measurement obtained in the same manner as in the measurement of the hardness of the member 30. However, the elastic modulus is calculated by the formula below, using the "inclination of the tangent to the unloading curve at maximum load (tangent stiffness S=dP/dh)" and the "area in which the indenter and a measurement sample are in contact (projected contact area B)". The pushing depth of the indenter is 5 μm. The inclination of the tangent to the unloading curve at maximum load is calculated by the following method. As a prerequisite, it is assumed that a power law of the following formula (1) is established in the unloading curve. In the formula (1), A, hf, and m are respectively constants determined by applying the least-squares method to the unloading curve. The formula (2) is obtained by differentiating the formula (1). The inclination of the tangent to the unloading curve at maximum load is calculated from the formula (2). A, hf, and m are respectively calculated by applying the least-squares method to the unloading curve between 20% and 95% indenter pushing loads of the unloading curve.

$$P = A(h - hf)^m \quad \text{Formula (1)}$$

$$\frac{dP}{dh} = Am(h - hf)^{m-1} \quad \text{Formula (2)}$$

$$\text{Elastic modulus} = \frac{\sqrt{\pi}}{2}\frac{S}{\sqrt{B}} \quad \text{Formula (3)}$$

The inclination of the load curve when the member 30 is measured by the nano-indentation method is preferably 1 [μN/nm] or more and 5 [μN/nm] or less. The inclination of the load curve is calculated based on the result of measurement obtained in the same manner as in the measurement of the hardness of the members 30. As the inclination of the load curve, the inclination when the indenter pushing depth falls between 50% and 85% is employed. Since the indenter pushing depth is 5 μm in the above measurement, the inclination of the load curve is determined as an inclination when displacement falls between 2.5 μm and 4.25 μm.

To allow the member 30 to have a larger hardness, a larger elastic modulus, and a larger inclination of the load curve by the nano-indentation method, a larger amount of resin material having a larger elastic modulus is for example mixed with the member 30. On the other hand, to allow the member 30 to have a smaller hardness, a smaller elastic modulus, and a smaller inclination of the load curve, a larger amount of plasticizer, a larger amount of resin material having a lower elastic modulus, or the like is for example mixed with the member 30.

The minimum load of the load curve obtained by the measurement of the member 30 by the nano-indentation method is preferably −0.40 μN or more and 0 μN or less, more preferably −0.10 μN or more and 0 μN or less. The minimum load of the load curve being −0.10 μN or more and 0 μN or less allows the member 30 to have substantially no wettability, and thus to exert better slidability. The minimum load of the unloading curve obtained by the measurement of the member 30 by the nano-indentation method is preferably −1.50 μN or more and 0 μN or less, more preferably −0.10 μN or more and 0 μN or less. The minimum load of the unloading curve being −0.10 μN or more and 0 μN or less allows the member 30 to have substantially no adsorption force (adhesive force), and thus to exert better slidability. To increase the minimum load of the load curve and the minimum load of the unloading curve by the nano-indentation method, a larger amount of hard material having low adhesiveness is for example mixed with the member 30. On the other hand, to decrease the minimum load of the load curve and the minimum load of the unloading curve, a larger amount of soft material having good adhesiveness is for example mixed with the member 30.

The projection constituting member 30 is made of a material having the aforementioned hardness. The projection constituting member 30 is made of, for example, a resin including at least a resin material. Such a resin material employable is one or more selected from: a polyolefin resin such as polyethylene (PE), polypropylene (PP), or an ethylene-propylene copolymer; an ethylene vinyl acetate copolymer (EVA); a styrene-based thermoplastic elastomer resin (a styrene-based block copolymer) such as SIS or SEBS; an acrylic resin; polyvinyl chloride resin or CEBC resin; a polyester such as PET; a polyurethane resin; a polyimide resin; a polyamide resin; and a polycarbonate resin. The projection constituting member 30 is not particularly limited, but is preferably formed of a material including, as the main component, one or more resins selected from a group consisting of: a polyolefin resin, a polyester resin, an ethylene vinyl acetate resin (EVA), or a styrene-based thermoplastic elastomer resin such as SIS or SEBS; a polyolefin-based elastomer resin; a polyurethane-based elastomer resin; an acrylic elastomer resin; an acrylic resin; and an polyamide resin. The projection constituting member 30 preferably includes more than 10 mass % of any of these resins. The projection constituting member 30 preferably includes 30 mass % or more of the aforementioned resin material. Among the aforementioned resin materials, at least one selected from a group consisting of a polyolefin resin, an ethylene vinyl acetate resin (EVA), the aforementioned styrene-based thermoplastic elastomer resins, an acrylic resin, and a polyamide resin. In other words, it is preferable that the projection constituting member 30 include at least one selected from a group consisting of polyolefin resin, an ethylene vinyl acetate resin (EVA), the aforementioned styrene-based thermoplastic elastomer resins, an acrylic resin, and a polyamide resin. It is particularly preferable that the projection constituting member 30 include at least one kind of resin selected from a group consisting of a polyolefin resin, an ethylene vinyl acetate resin (EVA), the aforementioned styrene-based thermoplastic elastomer resins, and an acrylic resin. The projection constituting member 30 including the preferable resin material as aforementioned suppresses the surface of the object to be cleaned from being damaged by the sliding contact. Further, the projection constituting members 30 including the preferable resin material as aforementioned can more sufficiently exert good slidability and good durability (strength).

The projection constituting member 30 may include at least one of wax, a cured resin, and an inorganic powder in addition to the aforementioned resin material, to have a higher elastic modulus. It is particularly preferable that the projection constituting member 30 include wax to have better slidability. It is preferable that the projection constituting member 30 include an inorganic powder as an extender pigment. The projection constituting member 30 including wax or an extender pigment as an inorganic powder in addition to the aforementioned resin material further increases the slidability of the projection constituting member 30 itself, and further reduces the frictional force of the projection constituting member 30 itself, consequently increasing the slidability of the cleaner sheet 1 considerably.

Wax (solid wax) is in a solid form at normal temperature (20° C.), but changes to a paste form or a liquid form at a temperature higher than the melting point of wax (for example, a temperature 2 to 3 degrees higher than the melting point). The melting point can be measured with a commercially available melting point measuring instrument or differential scanning calorimeter (DSC). The melting point of wax is generally 50° C. or more and 130° C. or less, preferably 80° C. or more. Since wax is hard at normal temperature, the projection constituting member 30 including a wax has a relatively high hardness or elastic modulus at normal temperature. In contrast, wax is rapidly heat-melted at a temperature slightly higher than the melting point of wax to have a lower viscosity than that of the resin material. Thus, the projection constituting member 30 including wax has good processing suitability in hot-melt coating. The projection constituting member 30 including wax in addition to the resin material is suppressed from being easily stretched due to the presence of the resin material, and can thus have an advantage of being easily cut off. Thus, the cleaner sheet 1 can have tape cuttability.

The hardness of wax represented in penetration is generally 0.1 or more and 60 or less. The penetration of wax is preferably 50 or less, more preferably 35 or less, further preferably 30 or less, further preferably 15 or less, particularly preferably 10 or less. The penetration of wax may be 1 or more. The above penetration is a value measured according to Japan Industrial Standard (JIS K2235 2009 5.4 Method of penetration test), at a temperature of 25° C., at a load of 100 g, and for a duration of 5 seconds.

Examples of wax include a hydrocarbon-based wax or a non-hydrocarbon-based wax. Examples of the hydrocarbon-based wax include: a petroleum and mineral-based wax such as a paraffin wax, a ceresin wax, or a microcrystalline wax; or a synthetic wax such as a polyethylene wax (low molecular weight polyethylene), a polypropylene wax (low molecular weight polypropylene), or a Fischer-Tropsch wax. Examples of the non-hydrocarbon-based wax include: a natural wax such as caster wax, carnauba wax, Japan tallow, privet wax, beeswax, montan wax, candelilla wax, or rice wax; or a synthetic wax such as diheptadecyl ketone, dipentadecyl ketone, diundecyl ketone, or ditridecyl ketone. As wax, a hydrocarbon-based wax is preferable.

The following lists the specific examples of commercially available waxes. Examples include the microcrystalline waxes manufactured by Nippon Seiro Co., Ltd., trade names: Hi-Mic-1045 (melting point: 72° C., penetration: 37); Hi-Mic-1070 (melting point: 80° C., penetration: 20); Hi-Mic-2095 (melting point: 101° C., penetration: 8); Hi-Mic-1090 (melting point: 88° C., penetration: 6); and Hi-Mic-1080 (melting point: 84° C., penetration: 12). Examples include the Fischer-Tropsch waxes manufactured by Nippon Seiro Co., Ltd., trade names: FT115 (melting point: 113° C., penetration: 1); SX105 (melting point: 102° C., penetration: 1); FT-0165 (melting point: 73° C., penetration: 5); and FT-0070 (melting point: 72° C., penetration: 11). Examples include the Fischer-Tropsch waxes manufactured by Sasol Limited, trade names: SASOLWAX H1 (melting point: 112° C., penetration: 1); and SASOLWAX C80 (melting point: 88° C., penetration: 4-9). Examples include the low molecular weight polyolefin waxes manufactured by Sanyo Chemical Industries, Ltd., trade names: SANWAX 171-P (penetration: 5); SANWAX 151-P (penetration: 4); SANWAX 131-P (penetration: 4); SANWAX 161-P (penetration: 2); SANWAX E-310 (penetration: 5); SANWAX E-330 (penetration: 4); and SANWAX E-250P (penetration: 5). Examples of other waxes include: a polyethylene wax manufactured by YASUHARA CHEMICAL CO., LTD. trade name Neowax (melting point: 110° C., penetration: 5); and polyethylene waxes manufactured by Mitsui Chemicals, Inc., trade names: Hi-WAX HP10A (melting point: 116° C., penetration: 2); Hi-WAX 210P (melting point: 114° C., penetration: 4); Hi-WAX 210MP (melting point: 112° C., penetration: 3); Hi-WAX 4202E (melting point: 100° C., penetration: 5); Hi-WAX NL100 (melting point: 103° C., penetration: 3); and Hi-WAX NP056 (melting point: 124° C., penetration: 2).

The projection constituting member 30 preferably includes 5 mass parts or more, more preferably includes 10 mass parts or more, further preferably includes 50 mass parts or more, particularly preferably includes 100 mass parts or more, of wax based on 100 mass parts of the aforementioned resin material. It may include 300 mass parts or less, may include 250 mass parts or less, may include 200 mass parts or less, of wax based on 100 mass parts of the aforementioned resin material. The projection constituting member 30 may include only wax.

The projection constituting member 30 preferably includes 1 mass part or more, more preferably includes 5 mass parts or more, further preferably includes 50 mass parts or more, particularly preferably includes 100 mass parts or more, of the inorganic powder based on 100 mass parts of the aforementioned resin material. The projection constituting member 30 may include 400 mass parts or less, may include 250 mass parts or less, may include 200 mass parts or less, of the inorganic powder based on 100 mass parts of the aforementioned resin material. Examples of the inorganic powder include an extender pigment, a color pigment, and functional particles. Examples of the extender pigment include silica, titanium oxide, zinc oxide, magnesium carbonate, calcium carbonate, and talc. The projection constituting member 30 may include an organic pigment or an organic dye in addition to the inorganic powder.

In the case where the projection constituting member 30 includes the resin material, the extender pigment (inorganic powder), and the wax, the projection constituting member 30 may include 1 mass part or more and 300 mass parts or less of the extender pigment based on 100 mass parts of the resin material, or may include 1 mass part or more and 300 mass parts or less of the wax based on 100 mass parts of the resin material.

The projection constituting members 30 may include a cured resin. Examples of the cured resin include a resin obtained by curing, with energy rays such as ultraviolet rays or electron beams, an uncured resin curable with the energy rays. Specific examples of the cured resin include the cured resin of an ultraviolet curing (UV curing) resin, and the cured resin of an electron beam curing (EB curing) resin. The cured resin may be a two-component reactive cross-linking type cured product. For example, the projection constituting member 30 having a sufficient hardness and a sufficient elastic modulus can be produced by coating with the composition of the projection constituting member 30 with which the UV curing resin is mixed, followed by subjecting the composition to UV irradiation for curing. Thus, the cleaner sheet 1 having good slidability can also be obtained.

The projection constituting member 30 preferably includes 10 mass parts or more, more preferably includes 50 mass parts or more, of the cured resin based on 100 mass parts of the resin material (thermoplastic resin). The projection constituting member 30 may include 400 mass parts or less, may include 200 mass parts or less, of the cured resin based on 100 mass parts of the resin material. The projection constituting member 30 may include only the cured resin.

The cleaner sheet 1 of this embodiment may include a fiber assembly, which is generally called woven fabric or nonwoven fabric, in the projection constituting member 30 and/or the adhesive layer 40. In other words, the projection constituting member 30 and the adhesive layer 40 may be at least partially formed of the fiber assembly. The fiber assembly refers to an assembly of fibers normally having a thickness of less than 0.03 mm. The fiber assembly is produced by, for example, the melt-blowing method.

The basis weight of the projection constituting member 30, that is, the mass of the member 30 per unit area of the cleaning surface 10, is appropriately set in consideration, for example, of slidability. The basis weight is preferably 5 $g/m^2$ or more, more preferably 10 $g/m^2$ or more, further preferably 20 $g/m^2$ or more, particularly preferably 30 $g/m^2$ or more, more particularly preferably 40 $g/m^2$ or more, most preferably 50 $g/m^2$ or more. When the projection constituting member 30 is made of the same material and the plurality of line members are respectively arranged in the same manner, the projections 12 are supposed to have a higher projecting height or the adhesive layer 40 is supposed to have a smaller exposure ratio as the basis weight becomes larger. Thus, a larger basis weight can achieve a smaller average adhesive force in the entire cleaning surface 10. This can easily exert better slidability. The basis weight is preferably 500 $g/m^2$ or less, more preferably 400 $g/m^2$ or less, further preferably 300 $g/m^2$ or less, particularly preferably 200 $g/m^2$ or less, in terms of being able to exert better dust or dirt capturing capability.

The average projecting height of the projections 12 (i.e., average projection height H) is set at least in consideration of slidability. The average projecting height of the projections 12 (i.e., average projection height H) is appropriately set in consideration also of dust or dirt capturing capability and durability. The average projecting height of the projections 12 is an average height of the projections 12 each extending from its distal end to each corresponding adhesive recess 14. The average projecting height of the projections 12 (H: mm) is measured by a surface roughness meter or by cross-sectional observation using a microscope. The average projecting height of the projections 12 (i.e., average projection height H) is preferably $1000\times10^{-3}$ mm or less, more preferably $500\times10^{-3}$ mm or less, in terms of exerting better dust or dirt capturing capability. In some cases, the average projecting height (i.e., average projection height H) may be $300\times10^{-3}$ mm or less, may be $200\times10^{-3}$ mm or less. The average projecting height of the projections 12 (i.e., average projection height H) may be $30\times10^{-3}$ mm or more, may be $50\times10^{-3}$ mm or more, may be $70\times10^{-3}$ mm or more. In some cases, the average projecting height (i.e., average projection height H) may be $100\times10^{-3}$ mm or more, may be $300\times10^{-3}$ mm or more. The average projecting height of the projections 12 (i.e., average projection height H) falling within the aforementioned preferable range reduces the frictional force at the time of the sliding contact to obtain better slidability and to enable the cleaning surface 10 to be made to more smoothly slide on the surface of the object to be cleaned. The exposed surfaces of the adhesive layer 40 that are arranged to be recessed respectively from the distal ends of the projections to the depth at the abovementioned value or more can further suppress the cleaning surface 10 from being unintentionally stuck to the object to be cleaned. The appropriate average projecting height of the projections 12 can be set, for example, in the case where the support base 50 is formed of, for example, paper having low cushioning properties or formed of, for example, nonwoven fabric or foam having high cushioning properties.

Each of the projections 12 has a distal end portion preferably formed into a tapered shape, more preferably formed into a round shape. In other words, it is preferable that the distal end portion have such a shape that the cross-sectional area of each projection 12 taken along the plane direction of the cleaning surface 10 is made smaller as it is taken closer to the distal end of the projection 12. In the case where the distal end portion has a tapered shape, the distal end thereof does not necessarily have a sharp shape but may have a flat shape. The distal end portions of the projections 12 having a tapered shape can further reduce the frictional force when the projections 12 are made to slide on the object to be cleaned. Accordingly, better slidability can be exerted.

(Adhesive Recess)

In this embodiment, the adhesive recesses 14 are a part of the adhesive layer 40 to be described below. In other words, the adhesive recesses 14 are composed of a part of the adhesive layer 40. Further in other words, the adhesive layer 40 is partially exposed to constitute the adhesive recesses 14. The line members of the member 30 are arranged at the intervals A from each other so that the surface of the adhesive layer 40 is partially exposed in the intervals A while the remaining part of the surface of the adhesive layer 40 is covered with the members 30. As will be described later, the cleaner sheet of the present invention is not limited to such a configuration.

As shown in FIG. 1, the adhesive layer 40 in this embodiment continuously extends over the plane direction of the cleaning surface 10. The shape of each of the adhesive recesses 14 when the cleaning surface 10 is seen in the thickness direction of the cleaner sheet 1 is not particularly limited. Each of the adhesive recesses 14 does not necessarily have a fixed shape. However, each of the adhesive recesses may have a polygonal shape such as a quadrilateral shape or a triangular shape, a circular shape such as a perfect circle shape or an oval shape, or other irregular shapes.

The proportion of the exposed area of the adhesive layer 40 in the cleaning surface 10 (hereinafter referred to simply as the exposure ratio) is preferably 30% or more, more preferably 40% or more, further preferably more than 50%, particularly preferably 60% or more. The exposure ratio being 30% or more, more preferably being more than 50% enables a single sheet to be used for cleaning a larger area of the object to be cleaned, while suppressing the adhesive recesses from being clogged with dust or dirt. This configuration enables a single sheet to more sufficiently capture dust or dirt in the adhesive recesses 14. Thus, the cleaner sheet 1 having good slidability can further have good dust or dirt capturing capability. The exposure ratio may be 95% or less, may be 90% or less. The upper limit of the exposure ratio being 95% or less can exert better slidability. It is preferable that the exposure ratio be larger in terms of more suppressing the clogging by dust or dirt and in terms of more sufficiently capturing dust or dirt. However, as disclosed in the aforementioned Patent Literature 1, the larger the exposure ratio, the more likely the adhesive layer 40 is to come in contact with the object to be cleaned. This can result in occurrence of adhesive residue or difficulties in handling at the time of cleaning. The cleaner sheet 1 even having a relatively large exposure ratio can still have good slidability achieved by selecting the material of the projection constituting member 30 or setting the ratio (H/L) to be described later. For example, the cleaner sheet 1 in which the support base 50 and the projection constituting member 30 are directly superposed on each other can be produced by bonding the support base 50 and the projection constituting member 30 together, or by coating the support base 50 with the projection constituting member 30, as will be described later. In the case where the cleaner sheet 1 is produced by the coating method, the exposure ratio can be appropriately set to achieve good slidability and dust or dirt capturing capability, depending on the material of the projection constituting member 30, the member thickness of the support base 50 in the thickness direction, or the like. In the production method in which a fiber sheet is punched to form circular holes therethrough and then an adhesive sheet is attached to the fiber sheet, as in the aforementioned Patent Literature 1, the fiber sheet has relatively low strength, and can thus have a limited size and number of holes, possibly resulting in a restricted exposure ratio. On the other hand, producing the projection constituting member 30 by the coating can directly form the projection constituting member 30 on the support base 50 or the adhesive layer 40, and can thus set the exposure ratio to any value. Further, producing the projection constituting members 30 by the coating enables the projection constituting member 30 to be easily formed into any shape other than a continuous pattern with the holes as in the Patent Literature 1. For example, the projection constituting members 30 having a given non-continuous pattern can be easily formed.

The exposure ratio is a proportion of the total exposed area of the adhesive layer 40 occupied to the total area of the cleaning surface 10. The total area of the cleaning surface 10 represents the area of a portion in which the projection constituting member 30 extends over the plane direction, or the area of the adhesive layer 40, whichever is larger. In the case where the area of the adhesive layer 40 is employed as the total area of the cleaning surface 10, the area of the adhesive layer 40 is determined as the area inside the adhesive composition arranged on the outermost side in the plane direction, even when the adhesive layer 40 does not continuously extend over the plane direction. The exposure ratio can be determined from the total exposed area of the adhesive layer 40 per unit area of the cleaning surface 10. The exposure ratio can be determined, for example, in the manner below. Specifically, an appearance photo of the member 30 is taken, enlarged on, for example, a sheet of copy paper, and cut with, for example, scissors so as to conform to the shape in which the adhesive layer 40 is exposed. Then, the mass of the paper that has been cut off per unit area is divided by the mass of paper per unit area to be able to obtain the precise exposure ratio. The precise exposure ratio can be calculated also by processing images captured by, for example, a microscope. The exposure ratio is measured by the same method in the Examples later. The measurement of the exposure ratio is preferably performed for the entire area of the cleaning surface 10, but may be performed for an arbitrarily selected 3 cm×3 cm square portion in the case where the members are arranged in a regular pattern. In the case where the members are arranged in the cleaning surface 10 not in a regular pattern but in a partially irregular pattern, the exposure ratio is measured for the entire area of the cleaning surface 10. If the support base 50 is exposed on the cleaning surface 10, the area of the portion in which the support base 50 is exposed is not included in the total exposed area of the adhesive layer 40 in calculating the exposure ratio. For example, in the case where the support base 50 and the adhesive layer 40 are exposed in the portions respectively between the plurality of line members of the projection constituting member 30, only the area of the portions in which the adhesive layer 40 is exposed is included in the total exposed area of the adhesive layer 40, and the area of the portions in which the support base 50 is exposed is not included in the total exposed area of the adhesive layer 40.

The cleaning surface 10 generally includes the first direction in which the average length in the plane direction of the intervals becomes a minimum value. For example, the first direction in this embodiment is a direction orthogonal to the direction in which the line members of the projection constituting member 30 extend. In the first direction, the average length (L: mm) of the adhesive recesses 14 respectively in the intervals A formed by the projection constituting member 30, that is, the average length (L: mm) of the adhesive recesses 14 in the first direction of the cleaning surface 10, is appropriately set in consideration of slidability and dust or dirt capturing capability. For example, the average length of the adhesive recesses 14 is preferably 10 mm or less, more preferably 8 mm or less, further preferably 5 mm or less, particularly preferably 3 mm or less, in terms of causing the cleaning surface 10 to exert better slidability. The average length of the adhesive recesses 14 being 10 mm or less results in a smaller average adhesive force of the entire cleaning surface 10, which can suppress an unused cleaner sheet from being attached to a packing material or another cleaner sheet. The average length of the adhesive recesses 14 is preferably 0.3 mm or more, more preferably 0.5 mm or more, further preferably 0.8 mm, particularly preferably 1.0 mm or more, in terms of causing the cleaning surface 10 to exert better dust or dirt capturing capability.

Figure 4:
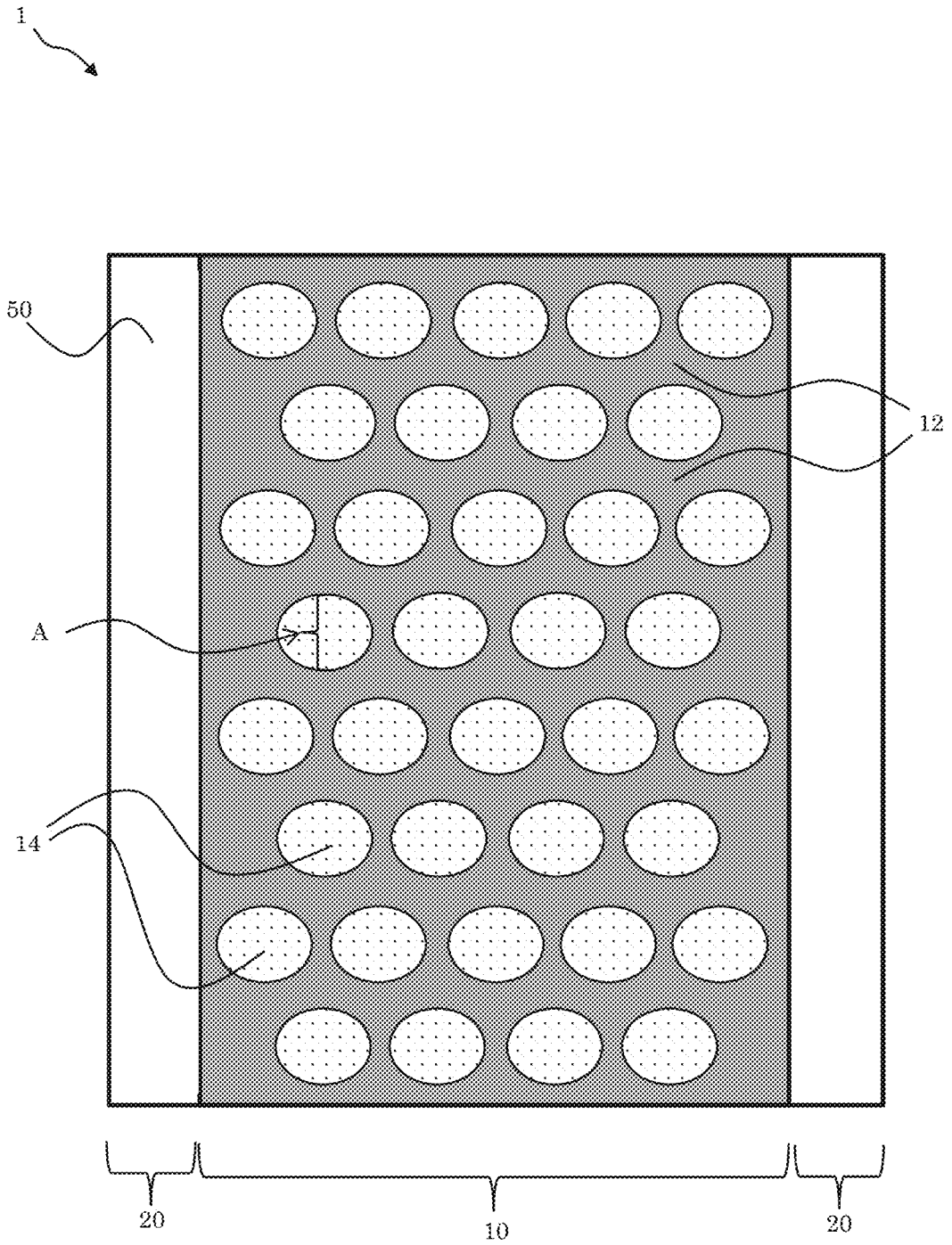
FIG. 4 is a schematic view of a cleaner sheet according to another embodiment as seen from one side (i.e., a cleaning surface side).
Figure 5:
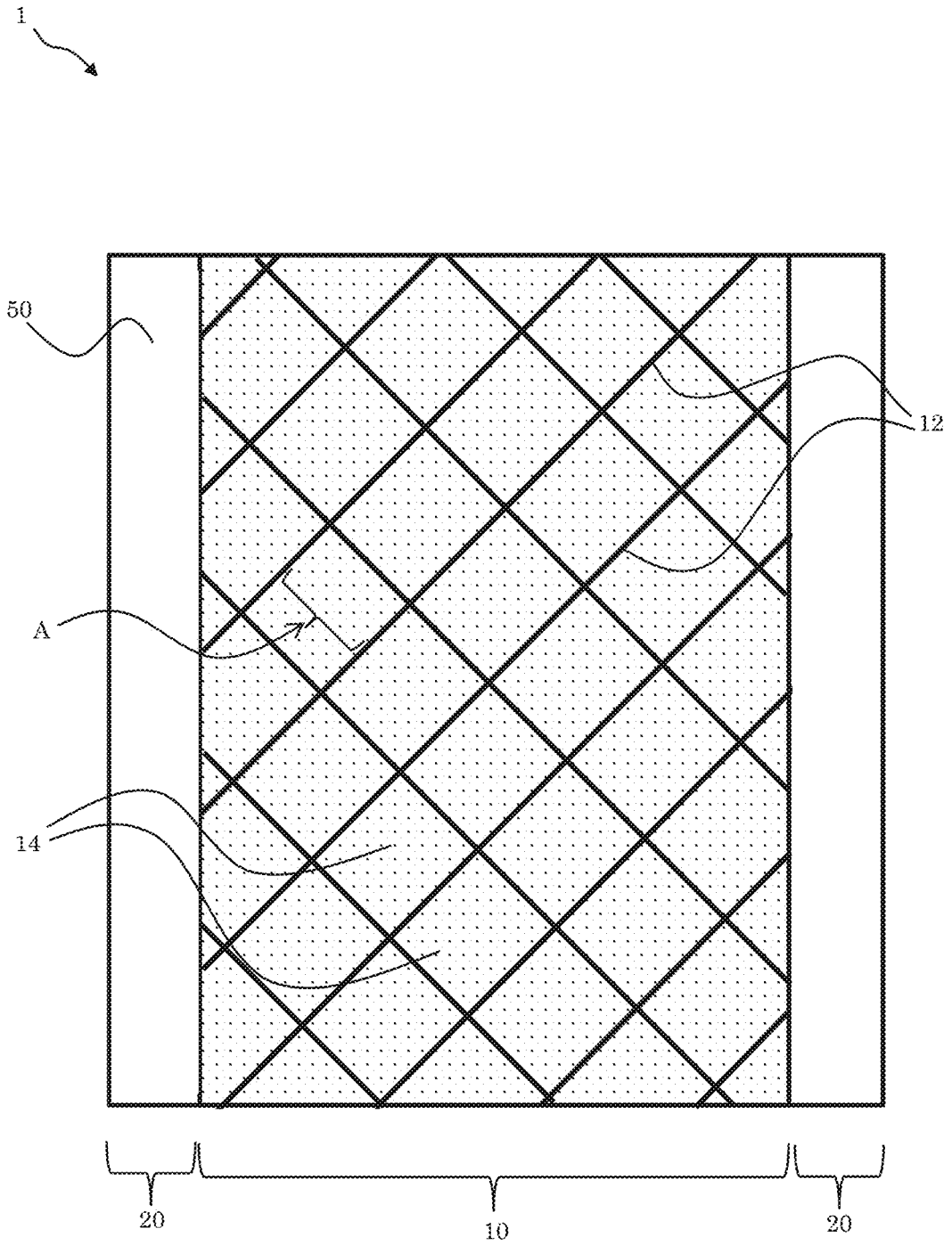
FIG. 5 is a schematic view of a cleaner sheet according to still another embodiment as seen from one side (i.e., a cleaning surface side).
Figure 6:
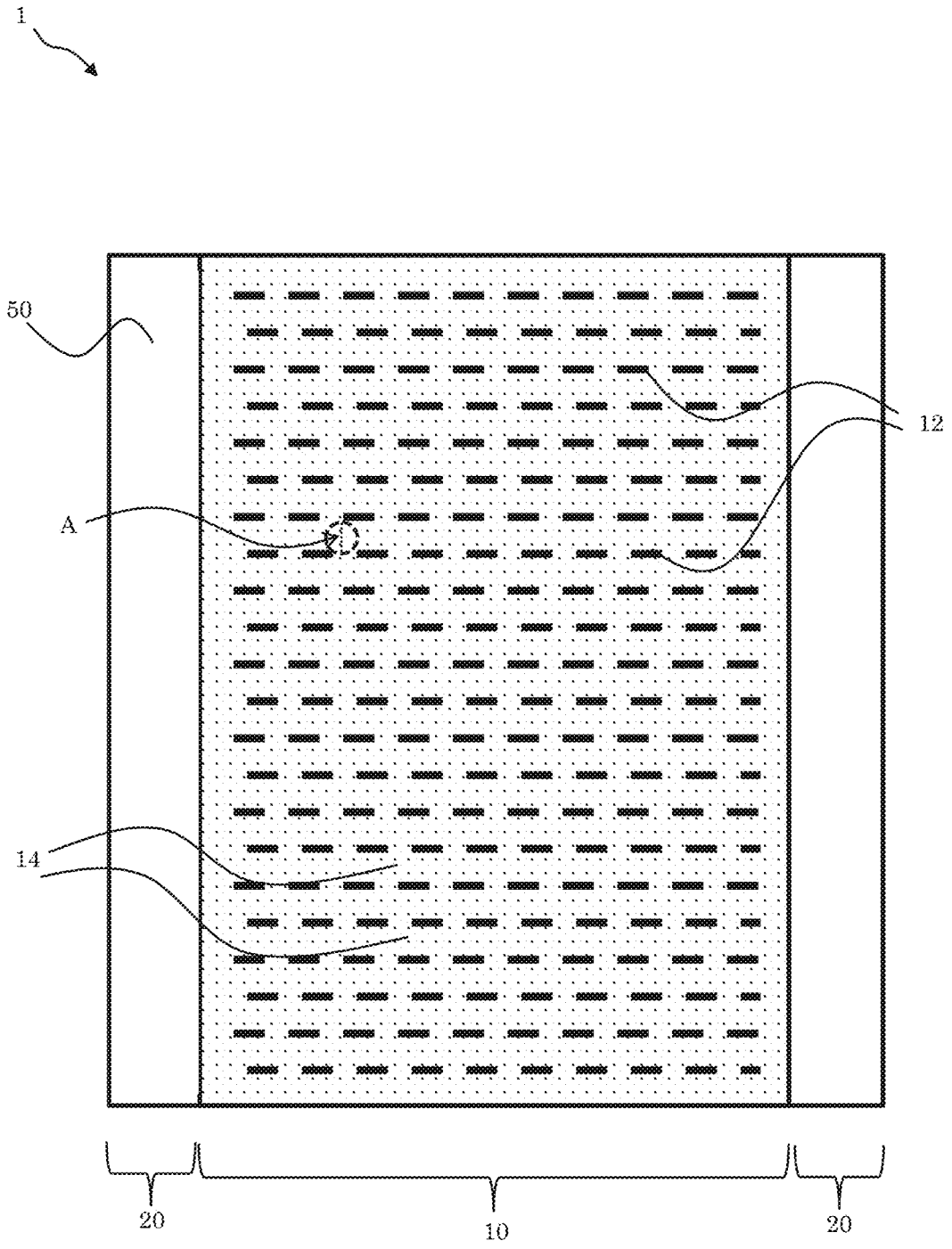
FIG. 6 is a schematic view of a cleaner sheet according to yet another embodiment as seen from one side (i.e., a cleaning surface side).
Figure 7:
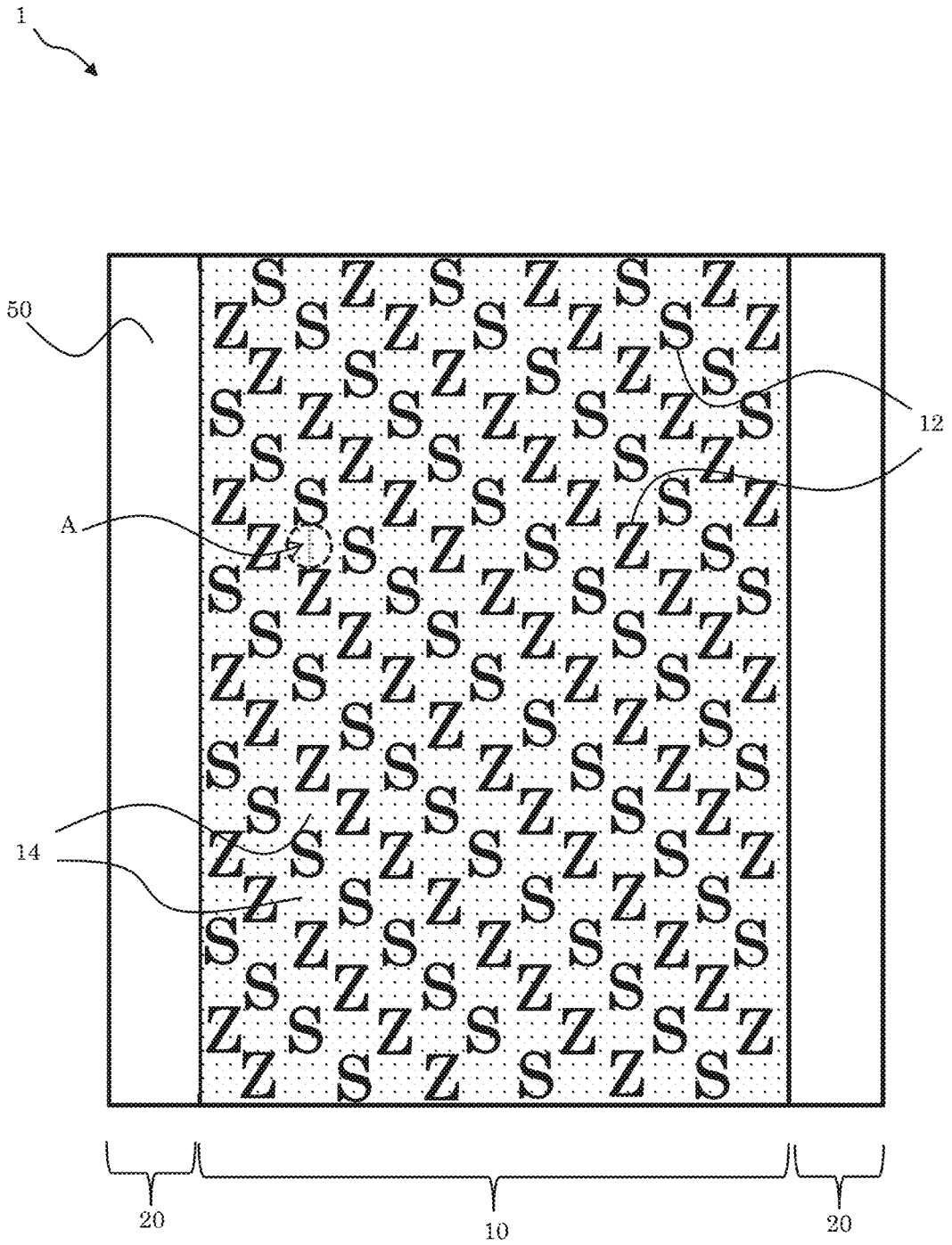
FIG. 7 is a schematic view of a cleaner sheet according to a kind of embodiment as seen from one side (i.e., a cleaning surface side).

The average length of the adhesive recesses 14 in the first direction is measured as follows. In principle, a virtual straight line for determining the first direction is set to pass a central portion of the cleaning surface in which the adhesive recess is present. In this embodiment, as shown in FIG. 1, the plurality of line members extend to be arranged in parallel with each other in one direction of the plane direction of the cleaning surface 10. Since the average length of the intervals in a direction in which the virtual straight line extends orthogonal to the line members becomes a minimum value, the first direction corresponds to the direction orthogonal to the line members (see the straight dashed line in FIG. 1). In this embodiment, as shown in FIG. 1, the projection constituting member 30 is constituted by the plurality of line members arranged in parallel with each other between which the intervals A having substantially the same size as each other are respectively provided; thus, the distance between each adjacent two line members is measured at least at 10 locations, and the measured values are averaged to obtain the average length. The measurement is performed in the same manner in the Examples described later. In the case where the adhesive recesses 14 have a round shape as shown in FIG. 4, and in the case where the adhesive recesses 14 have a rectangular shape as shown in FIG. 5, the first direction is also determined in the same manner as aforementioned to obtain the average length of the adhesive recesses 14. In the case where it is difficult to specify one direction as the first direction, on the other hand, the average length can be determined as follows. For example, in an assumed example of the projection constituting member 30, as shown in FIG. 6, short line members are intermittently arranged at intervals from each other in the longitudinal direction, and the short line members are arranged at substantially the same intervals from each other in the direction orthogonal to the longitudinal direction. In another assumed example of the projection constituting member 30, as shown in FIG. 7, the projection constituting member 30 is constituted by small members formed to look like letters. In such a case, the diameter of a maximum virtual circle (perfect circle) present in each interval between each adjacent two members so as to be inscribed in the members (see the circle drawn by dashed line) is regarded as the length of each of the adhesive recesses 14. At this time, at least three 3 cm×3 cm square portions are randomly selected, the length of the adhesive recesses 14 is measured at least at 10 locations of each of the square portions, and the measured values are averaged to obtain the average length.

In the cleaning surface 10, the ratio (H/L) between the average projection height (H: mm) from the distal end of each projection 12 to each corresponding adhesive recess 14 and the average length (L: mm) of the adhesive recesses in the first direction in which the average length of the intervals becomes a minimum value in the plane direction of the cleaning surface is preferably $15\times10^{-3}$ or more, more preferably $20\times10^{-3}$ or more, further preferably $25\times10^{-3}$ or more, particularly preferably $30\times10^{-3}$ or more, more particularly preferably $40\times10^{-3}$ or more, most preferably $45\times10^{-3}$ or more. In some cases, the ratio (H/L) may be $60\times10^{-3}$ or more, may be $70\times10^{-3}$ or more. The ratio (H/L) being $15\times10^{-3}$ or more results in a relatively large average projection height relative to the average length of the adhesive recesses 14, thereby further suppressing the adhesive recesses 14 from coming in contact with the surface of the object to be cleaned. This configuration allows the entire cleaning surface 10 to further reduce its frictional force and exert better slidability. As aforementioned, this configuration can further suppress the cleaning surface 10 from being unintentionally attached to the object to be cleaned. The ratio (H/L) is preferably $600\times10^{-3}$ or less, more preferably $300\times10^{-3}$ or less, further preferably $150\times10^{-3}$ or less, particularly preferably $100\times10^{-3}$ or less, more particularly preferably $80\times10^{-3}$ or less. The ratio (H/L) being $600\times10^{-3}$ or less allows the cleaning surface 10 to more easily exert its adhesive force and exert better dust or dirt capturing capability.

(Adhesive Layer)

In this embodiment, the adhesive layer 40 extends over the plane direction of the cleaning surface 10, and is arranged on the back side of the projection constituting member 30. The adhesive layer 40 is formed into layers by, for example, an adhesive composition. The cleaner sheet 1 of this embodiment has the cleaner sheet 10 that can be formed by placing the projecting constituting member 30 on the surface of the adhesive layer 40, and can thus be relatively easily produced. When the distal ends of the projections 12 are pressed and made to slide on the object to be cleaned at the time of cleaning the object to be cleaned with the cleaning surface 10 of the cleaner sheet 1, the projections 12 can be slightly forced into the adhesive layer 40 while being supported by the adhesive layer 40. This configuration causes the projections 12 to have a slightly smaller projecting height (projection height), and the adhesive recesses 14 recessed more than the projections 12 can be made slightly closer to the surface of the object to be cleaned. The closer the adhesive recesses 14 are made to the surface of the object to be cleaned, the more securely the adhesive recesses 14 can capture dust or dirt.

The adhesive composition forming the adhesive layer 40 includes an adhesive such as an acrylic adhesive, a rubber-based adhesive, a polyester-based adhesive, an urethane-based adhesive, a polyether-based adhesive, or a silicone-based adhesive. The adhesive composition can further include a tackifier, and a plasticizer such as a process oil. The kind and mixing ratio of each component are set depending on the intended use or the like of the cleaner sheet 1 so as to enable the cleaner sheet 1 to obtain desired adhesive performance. The rubber-based adhesive, for example, refers to an adhesive that includes a rubber-based polymer as the base polymer. The same applies to other adhesives. The base polymer of the adhesive is a polymer component included in the adhesive at the highest mixing ratio. The adhesive may include 50 mass % or more, may include 70 mass % or more, 90 mass % or more, of the base polymer based on the solid content. The adhesive may include the base polymer only, and may include, for example, 99 mass % or less of the base polymer. It is preferable that the adhesive be a rubber-based adhesive or an acrylic adhesive, in terms of exerting better adhesive performance and in terms of having relatively high cost-performance ratio of raw materials.

The acrylic adhesive includes an acrylic polymer as the base polymer. The acrylic polymer refers to a polymer having an acrylic monomer as the main constituent monomer component. The acrylic monomer is a monomer having at least one (meth)acryloyl group in a single molecule. The main constituent monomer component is a component accounting for 50 mass % or more of the total amount of the monomer components constituting the acrylic polymer. The acrylic monomer may account for 70 mass % or more, may account for 90 mass % or more, of the monomer components constituting the acrylic polymer. The acrylic polymer may be a radically polymerized homopolymer, or a randomly copolymerized copolymer. The acrylic polymer may be a thermoplastic (typically hot-melt type) block copolymer. The (meth)acryloyl group herein refers collectively to an acryloyl group and a methacryloyl group. Likewise, (meth) acrylate herein refers collectively to an acrylate and a methacrylate.

Examples of the rubber-based adhesive include an adhesive including, as the base polymer, one or more rubber-based polymers such as a natural rubber-based polymer, e.g., natural rubber and its modified product, an isoprene rubber, a chloroprene rubber, a styrene-isoprene-styrene block copolymer (SIS), a styrene-butadiene-styrene block copolymer (SBS), a styrene-ethylene/butylene-styrene block copolymer (SEBS), a crystalline polyolefin-ethylene/butylene-crystalline polyolefin block copolymer (CEBC), and a styrene-ethylene/butylene-crystalline polyolefin block copolymer (SEBC). The rubber-based adhesive is preferably an adhesive including a SIS as the base polymer (i.e., a SIS-based adhesive).

Examples of the tackifier include general rosin-based, terpene-based, hydrocarbon-based, epoxy-based, polyamide-based, elastomer-based, phenol-based, and ketone-based tackifiers. One of these can be used individually, or two or more of these can be used in combination appropriately. The mixing ratio of the tackifier based on 100 mass parts of the base polymer is not particularly limited, but may be, for example, 50 mass parts or more and 200 mass parts or less, and is preferably 80 mass parts or more and 150 mass parts or less.

Examples of the plasticizer include: a process oil; an acrylic oligomer; a phthalic ester-based plasticizer such as dioctyl phthalate, diisononyl phthalate, diisodecyl phthalate, or dibutyl phthalate; an adipate ester-based plasticizer such as dioctyl adipate or diisononyl adipate; a trimellitic acid ester such as trimellitic trioctyl; a sebacate; an epoxidized vegetable oil such as epoxidized soybean oil or epoxidized linseed oil; an epoxidized fatty acid alkyl ester such as epoxidized fatty acid octyl ester; and a cyclic fatty acid ester and a derivative thereof, such as sorbitan monolaurate, sorbitan monostearate, sorbitan monooleate, sorbitan trioleate, or their ethylene oxide adducts. As the plasticizer, one of these can be used individually, or two or more of these can be used in combination appropriately. In the adhesive composition, the mixing ratio of the plasticizer based on 100 mass parts of the base polymer is not particularly limited, but may be, for example, 50 mass parts or more and 200 mass parts or less, and is preferably 90 mass parts or more and 150 mass parts or less. Examples of the process oil include general paraffinic, naphthenic, and aromatic process oils.

The adhesive composition (for example a composition including a SIS-based adhesive) may further include various additives such as an aging retardant, an antioxidant, an ultraviolet absorber, a light stabilizer, an antistatic agent, a lubricant, and a colorant (e.g., a pigment, a dye). The kinds and mixing amounts of these additives may be the same as the kinds and mixing amounts applicable to the general field of adhesives.

Various types of the adhesive compositions are employed for preparing the adhesive layer 40. Examples of the compositions employable include: a hot-melt type composition that is heated and molten, followed by being cooled and solidified to form the adhesive layer 40; a curable type composition that includes a curing agent as appropriate; an energy ray irradiation curable type composition that is cured by being irradiated with energy rays such as ultraviolet rays (UV) or electron beams (EB); a water dispersible type (typically emulsion type) composition in which adhesive components are dispersed in water; and a solvent type composition in which adhesive components are dissolved in an organic solvent. It is preferable that a hot-melt type adhesive composition be employed to prepare the adhesive layer 40, in terms of achieving good productivity and reducing environmental loads.

The probe tack of the adhesive layer 40 measured by the probe tack method is preferably 1.0 kN/m$^2$ or more and 500.0 kN/m$^2$ or less. The adhesive layer 40 having a probe tack of 1.0 kN/m$^2$ or more enables the adhesive to be softer, and can more securely retain captured dust or dirt. Since the adhesive layer 40 has a probe tack of 500.0 kN/m$^2$ or less, the adhesive recesses 14 even when they come in contact with the surface of the object to be cleaned can be relatively easily removed from the surface of the object to be cleaned when the cleaning surface 10 being in sliding contact moves along the surface of the object to be cleaned. This configuration allows the cleaning surface 10 be more slidable on the surface of the object to be cleaned. Accordingly, the cleaner sheet 1 has better slidability. Since the adhesive layer 40 has a probe tack of 1.0 kN/m$^2$ or more and 500.0 kN/m$^2$ or less and the projection constituting member 30 has a hardness or 0.4 MPa or more as aforementioned, good dust or dirt capturing capability can be exerted while good slidability is exerted.

The measured probe tack value of the adhesive layer 40 measured by the probe tack method is preferably 250.0 kN/m$^2$ or less, further preferably 150.0 kN/m$^2$ or less. Since the adhesive layer 40 has a probe tack of 250.0 kN/m$^2$ or less, the adhesive recesses 14 even when they come in contact with the surface of the object to be cleaned can be relatively easily separated from the surface of the object to be cleaned when the cleaning surface 10 moves along the surface of the object to be cleaned while being in sliding contact therewith. This configuration allows the cleaning surface 10 be more slidable on the surface of the object to be cleaned. Accordingly, the cleaner sheet 1 has better slidability. The measured probe tack value of the adhesive layer 40 may be 5.0 kN/m$^2$ or more, may be 10.0 kN/m$^2$ or more, may be 25.0 kN/m$^2$ or more, may be 50.0 kN/m$^2$ or more. To increase the measured probe tack value of the adhesive layer 40, for example a reasonable amount of tackifier or plasticizer is included in the adhesive layer 40. To decrease the measured probe tack value of the adhesive layer 40, for example the amount of tackifier or plasticizer included in the adhesive layer 40 is further reduced.

The probe tack of the adhesive layer 40 is measured with a probe tack tester. The measurement is conducted at least 10 times, and the measured values are averaged to obtain the probe tack value. As the detailed test conditions, a stainless-steel probe having a circular shape (with a diameter of 5 mm) is held in contact with the adhesive surface of the adhesive layer 40 for one second while being applied with constant load (50 gf/5 mmφ), and thereafter a force required to detach the probe by 5 mm from the adhesive surface is determined, which is determined as the probe tack (adhesive force) value of the adhesive layer. The measurement is conducted with the adhesive layer 40 superposed on the support base 50. The contact speed (attaching speed) of the probe is 120 mm/min, and the detaching speed thereof is 600 mm/min. The measurement is conducted under the environment of 23° C. and 50% RH.

The adhesive force of the adhesive layer 40 is appropriately set in consideration of the slidability and the dust or dirt capturing capability of the cleaner sheet 1. The adhesive force of the adhesive layer 40 is measured with peeling strength as follows. In terms of exerting better dust or dirt capturing capability, the 180-degree peeling strength of the adhesive layer 40 is preferably 0.5 N/25 mm or more, more preferably 1.0 N/25 mm or more, further preferably 3.0 N/25 mm or more, particularly preferably 5.0 N/25 mm or more. The adhesive layer 40 having an adhesive force of 1.0 N/25 mm or more can sufficiently capture dust or dirt such as household dust which is relatively light in weight. In terms of exerting good slidability on the object to be cleaned, and in terms of suppressing the cleaner sheet 1 from being attached to the surface of the object to be cleaned, the 180-degree peeling strength of the adhesive layer 40 is preferably 40 N/25 mm or less, more preferably 25 N/25 mm or less, further preferably 20 N/25 mm or less, particularly preferably 15 N/25 mm or less. The 180-degree peeling strength is a measured value based on the 180-degree peeling test for a stainless steel (SUS304) plate specified in JIS Z 0237. In the case where the adhesive layer 40 is formed not to extend over the plane direction of the cleaning surface 10 but, for example, to have a plurality of lines arranged in parallel with each other in one direction of the plane direction (i.e., to have a non-continuous coating film), the 180-degree peeling strength of the adhesive layer can be determined by converting the measured strength into the strength when the width is 25 mm as aforementioned. In the case where the adhesive layer 40 has the non-continuous coating film as aforementioned, the peak value (maximum value) observed in the measurement is employed to determine the 180-degree peeling strength since it is difficult to obtain an average value.

The peeling strength is measured specifically with the following steps. A sheet-shaped test specimen cut into a rectangular shape is taken out of the adhesive layer 40 supported by the support base 50. The test specimen has a length preferably of about 100 to 200 mm, and a width preferably of about 15 to 25 mm. In the case where the width of the test specimen is less than 25 mm, the conversion value [N/25 mm] can be calculated (converted) based on the ratio between the actual width of the test specimen and the reference width of 25 mm. The thickness of the test specimen is not particularly limited. One surface of the test specimen (i.e., the surface on the cleaning surface side) is attached to the stainless-steel (SUS304) plate, and is brought into press contact by reciprocating a 2 kg roller once thereon. In the case where both surfaces of the test specimen have adhesiveness, the surface of the test specimen opposite to the surface to be measured is preferably subjected to backing with a polyethylene terephthalate (PET) film having a thickness of about 25 μm. The test sample thus prepared is retained under the environment of 23° C. and 50% RH for 30 minutes. Thereafter, a tensile tester is used to measure the 180 degree peeling strength (adhesive force to SUS) [N/25 mm] according to JIS Z 0237, under the environment of 23° C. and 50% RH, at a peeling angle of 180 degrees, and at a tensile speed of 300 mm/min. The tensile tester to be used is not particularly limited, and conventionally known tensile testers can be used. For example, "TENSILON" manufactured by Shimadzu Corporation can be used.

The average thickness of the adhesive layer 40 (or the average total thickness of the plurality of adhesive layers in the case where the adhesive layer has a multilayered structure) can be appropriately set depending on the purposes, and is thus not particularly limited. In terms of exerting better dust or dirt capturing capability, the average thickness of the adhesive layer 40 is preferably 1 μm or more, more preferably 5 μm or more, further preferably 10 μm or more, particularly preferably 15 μm or more. In terms of exerting better slidability and preventing adhesive residue on the object to be cleaned, the average thickness of the adhesive layer 40 is preferably 300 μm or less, more preferably 150 μm or less, further preferably 60 μm or less, particularly preferably 40 μm or less. The average thickness is the average of the measured values obtained at least at five randomly selected locations.

(Support Base)

The cleaner sheet 1 preferably includes the support base 50. The cleaner sheet 1 including the support base 50 allows the adhesive layer 40 to be supported by the support base 50, and thus can suppress deformation of the adhesive layer 40 during the sliding contact. Accordingly, the adhesive layer 40 exerts sufficient adhesive performance and exerts better dust or dirt capturing capability.

The tensile strength of the support base 50 is preferably 5 N/50 mm or more. The tensile strength of the support base 50 being 5 N/50 mm or more allows the adhesive layer 40 to be sufficiently supported by the support base 50. With this configuration, the projections 12 can be slightly forced into the adhesive layer 40 while being more sufficiently supported by the adhesive layer 40 during the sliding contact, as aforementioned. Accordingly, the adhesive recesses 14 can be made slightly close to the surface of the object to be cleaned. The closer the adhesive recesses 14 are made to the surface of the object to be cleaned, the more securely the adhesive recesses 14 can capture dust or dirt. The strength of the support base 50 may be 200 N/50 mm or less.

The tensile strength of the support base 50 is determined by measuring the tensile strength of the support base 50. Specifically, such a strength (tensile strength) is measured by setting a test specimen cut into a belt shape having a width of 50 mm on a tensile tester (with a distance between chucks of 100 mm) to measure the tensile strength [N/50 mm] at a tensile speed of 200 mm/min.

The support base 50 may be of various resin sheets; fiber sheets such as nonwoven fabric, woven fabric, and paper; metal foils; their composites thereof, or the like. The support base 50 preferably has at least one kind of the resin sheets and the fiber sheets. Examples of the resin sheets include a synthetic resin film, a rubber sheet, and a foam sheet. Examples of the fiber sheets include nonwoven fabric, woven fabric, and paper. The shape of the support base 50 is not particularly limited, and may be, for example, a flat plate shape or a cylindrical shape. The support base 50 may be of a deformable material such as cloth or sponge. The support base 50 may be formed of a polyolefin, a polyester, or other synthetic resins; of paper; of synthetic fibers or natural fibers; or of a metal such as stainless steel.

Examples of the material of the resin sheet include a polyolefin (e.g., PE, PP, ethylene-propylene copolymer), a polyester (e.g., PET), a polyvinyl chloride resin, a vinyl acetate resin, a polyimide resin, a polyamide resin, and fluororesin. Examples of the rubber sheet include a natural rubber sheet and a butyl rubber sheet. Examples of the foam sheet include various foamed resin sheets made of, for example, polyethylene, polypropylene, polyurethane, an ethylene vinyl acetate copolymer (EVA), or polyethylene terephthalate (PET). Examples of the paper include Japanese paper, kraft paper, glassine paper, high quality paper, synthetic paper, and topcoat paper. Examples of the woven fabric or the nonwoven fabric include a fabric formed of a single kind of fibers, or formed by blending a plurality of kinds of fibers. Examples of the fibers include cotton, staple fibers, Manila hemp fibers, pulp, rayon fibers, acetate fibers, polyester fibers, polyvinyl alcohol fibers, polyamide fibers, and polyolefin fibers. A method for producing the nonwoven fiber can be spun lacing, chemical bonding, melt blowing, steam jetting, needle punching, or any other method. Examples of the metal foil include aluminum foil and copper foil.

In the case where the nonwoven fabric or foam having a large surface roughness (unevenness) is directly used as the support base 50, there are some cases where the projection constituting member 30 and/or the adhesive layer 40 superposed on the support base 50 cannot sufficiently adhere to the support base 50. Such a nonwoven fabric or foam is preferably covered with a polyethylene film or a polypropylene film to allow the surface of the support base 50 to become a flat and smooth surface. The surface of the support base 50 that has become the flat and smooth laminated surface enables the projection constituting member 30 and the adhesive layer 40 to be quickly formed thereon by the coating to be described later. This configuration allows the projection constituting member 30 and the adhesive layer 40 to be relatively quickly and easily formed.

The support base 50 may include various additives such as a filler (e.g., an inorganic filler, an organic filler), an aging retardant, an antioxidant, an ultraviolet absorber, a light stabilizer, an antistatic agent, a lubricant, a plasticizer, and a colorant (e.g., a pigment, dye), as appropriate.

The thickness of the support base 50 is not particularly limited, and can be appropriately selected depending on the purpose. The thickness of the support base 50 is preferably 5 μm or more, more preferably 10 μm or more, further preferably 20 μm or more. The thickness of the support base 50 is preferably 5 mm or less, more preferably 3 mm or less, particularly preferably 1 mm or less. The configuration may also be such that a rubber plate is employed as the support base 50, and the adhesive layer 40 and the projection constituting member 30 are provided on the support base 50 to form the cleaner sheet 1. The aforementioned thickness is appropriately designed for the support base 50 formed of, for example, the synthetic resin sheet, the nonwoven fabric, or the paper.

The cleaner sheet 1 of this embodiment includes the cleaning surface having unevenness, and is used mainly with the distal ends of the projections brought into sliding contact with the object to be cleaned. Accordingly, the cleaning surface can move along the surface of the object to be cleaned without bringing the adhesive recesses, which have relatively high adhesive force and are recessed from the projections, into contact with the object to be cleaned. This can relatively reduce the frictional force during the sliding contact. The cleaner sheet can be made to slide on the surface of the object to be cleaned with relatively small frictional force, and thus has good slidability. Since the hardness of the projection constituting member 30 measured by the nano-indentation method is 0.4 MPa or more, the frictional force can be relatively reduced between the surface of the object to be cleaned and the projections 12 held in sliding contact with the surface of the object to be cleaned during the sliding contact. Thus, the cleaner sheet 1 including the cleaning surface 10 that has the member with such a relatively large stiffness has good slidability. The cleaner sheet 1 of this embodiment can excellently capture dust or dirt with the adhesiveness of the adhesive recesses 14. For example, dust or dirt on the object to be cleaned is captured by the adhesive recesses 14 of the cleaning surface 10 when the wiping operation by a cleaning operator causes the cleaner sheet 1 to be brought into sliding contact with the object to be cleaned. The captured dust or dirt is collected in hollows near the adhesive recesses 14. Further, even when relatively heavyweight dust or dirt is captured, the dust or dirt can still be kept captured by the adhesive force of the adhesive recesses 14. On the other hand, when heavyweight dust or dirt is captured with a conventional member formed only of a fiber assembly, the captured dust or dirt is likely to be once separated from the fiber assembly by its own weight. As described above, according to the cleaner sheet 1, even relatively heavyweight dust or dirt such as sand grains, which are relatively difficult to be kept captured, can still be kept captured by the adhesive force of the adhesive recesses 14. Thus, the cleaner sheet 1 has good dust or dirt capturing capability. The projection constituting member 30 having a hardness of 0.4 MPa or more is suppressed from being worn away by the sliding contact during cleaning. Thus, the cleaner sheet 1 has good durability. As described above, the cleaner sheet 1 configured as above has good slidability and has good dust or dirt capturing capability and durability.

(Other Arbitrary Layers and Members)

The cleaner sheet 1 of this embodiment may further include one or more layers as appropriate, in addition to the aforementioned projection constituting member 30, the adhesive layers 40, and the support base 50. For example, an intermediate layer may be arranged between the projection constituting member 30 and the adhesive layer 40 in order to impart reasonable thickness, cushioning properties, strength, or the like to the cleaner sheet 1. The intermediate layer may be a layer in which the same intervals as the intervals A in the projection constituting member 30 are formed. The configuration of the intermediate layer is not particularly limited, and may be a resin layer formed from various resin materials, a rubber layer (e.g., a natural rubber sheet, a butyl rubber sheet), a foam layer, a fiber layer (e.g., paper, cloth, a woven fabric or a nonwoven fabric formed of a single or blended fibrous materials), or a metal layer (typically a metal foil). An anchor layer may be provided between the adhesive layer 40 and the support base 50 to increase anchoring properties. Various coat layers may be provided on the back surface (the surface with no adhesive layer formed) of the base support 50 for improved design or easier handling. In the cleaner sheet having the cleaning surface only on one side, a sticky layer may be superposed on the back side (the opposite side to the cleaning surface) of the support base. The adhesive force of the sticky layer is higher than the projection constituting member but lower than the adhesive layer. The sticky layer may be formed of an ethylene vinyl acetate resin (EVA). When a plurality of the cleaner sheets each having such a sticky layer are laid on top of each other in the thickness direction to be directed to the same direction, or when the cleaner sheet having the sticky layer is wound onto itself, the sticky layer can suppress the stacked cleaner sheets from being displaced from each other, and suppress the stacked cleaner sheets from firmly adhering to each other. Further, the configuration may be such that the projections are formed of a self-adhesive material having self-adhesiveness, and the back surface of the support base is formed of such a self-adhesive material. Examples of the self-adhesive material include a low-molecular tackifier and a chloroprene rubber. The projections formed of the self-adhesive material do not have much adhesiveness unless they come into contact with another self-adhesive material, and can thus exert slidability. In the case where the back surface of the support base of the cleaner sheet is also formed of the self-adhesive material, the self-adhesive material can suppress the cleaner sheets stacked as above from being displaced from each other, and can suppress the stacked cleaner sheets from firmly adhering to each other.

Figure 8:
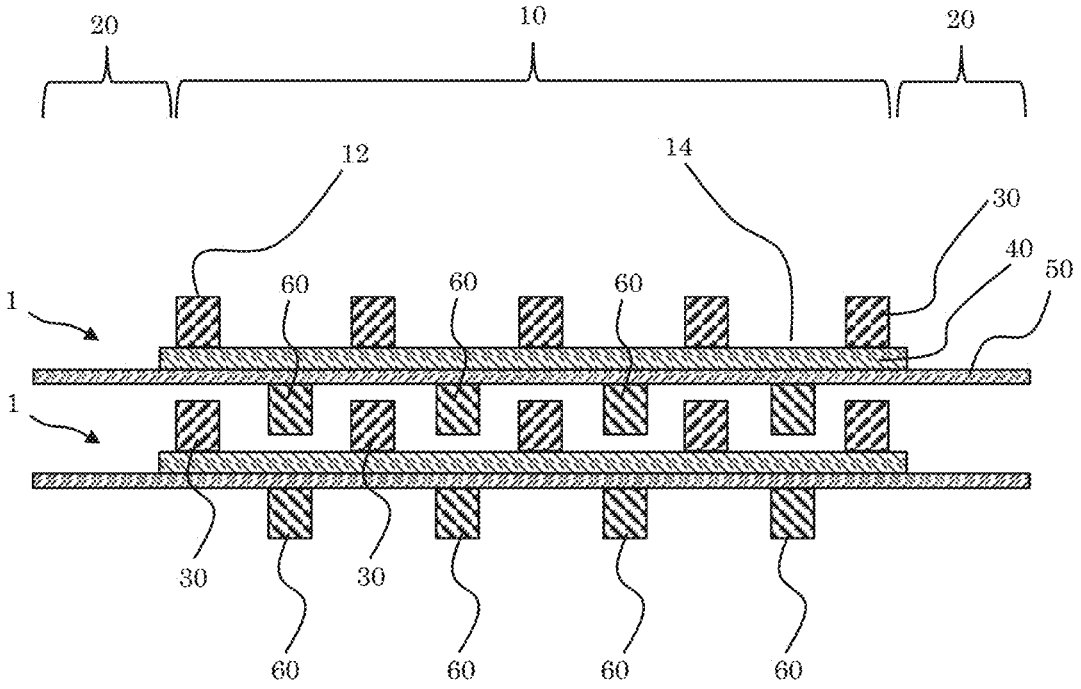
FIG. 8 is a schematic cross-sectional view of cleaner sheets according to one embodiment that are placed over each other in a thickness direction.

In the cleaner sheet having the cleaning surface only on one side, a back side member 60 similar to the projection constituting member 30 may be formed on the back side of the support base. For example, the back side member 60 is constituted by a plurality of line members as shown in FIG. 8, and these line members extend in the same direction as the direction in which the line members constituted by the projection constituting member 30 on the front side extend. When a plurality of the cleaner sheets each having such a configuration are laid on top of each other in the thickness direction to be directed to the same direction, or when the cleaner sheet having such a configuration is wound onto itself, the projections of the projection constituting member and the projections of the back side member 60 can be arranged alternately with each other, which suppresses the stacked sheets from being displaced from each other. Specifically, the line members of the projection constituting member 30 of one cleaner sheet fit respectively into the intervals between the line members of the back side member 60 of another cleaner sheet to be able to suppress the cleaner sheets from being displaced from each other in the width direction of the line members.

The total thickness of the cleaner sheet 1 of this embodiment is not particularly limited. The total thickness of the cleaner sheet 1 having a sheet shape may be 1800 μm or less, may be 1000 μm or less, may be 800 μm or less. The total thickness of the cleaner sheet 1 is preferably 500 μm or less, more preferably 300 μm or less, further preferably 250 μm or less, for more improved handling or the like. The total thickness may be 50 μm or more, may be 120 μm or more. The total thickness is preferably 150 μm or more, more preferably 180 μm or more, further preferably 200 μm or more, in terms of causing the cleaner sheet 1 to exert better slidability and in terms of causing the cleaner sheet 1 to exert better dust or dirt capturing capability, or the like. The total thickness is the average of the thicknesses at least at five randomly selected locations.

(Method for Producing Cleaner Sheet)

The method for producing the cleaner sheet 1 of this embodiment is a method in which the projection constituting member 30 is formed by coating.

In the above production method, the projection constituting member 30 can be formed by being superposed by the coating on the support base 50. In the production method, the projection constituting member 30 can be formed by being superposed by the coating on the adhesive layer 40. In superposing the projection constituting member 30 on the support base 50 or the adhesive layer 40 by the coating, the projection constituting member 30 may be directly superposed by the coating on the support base 50 or the adhesive layer 40, or the projection constituting member 30 once formed by the coating on another member may be transcribed into the support base 50 or the adhesive layer 40 (i.e., the transcription method).

The method for producing the cleaner sheet 1 of this embodiment includes, for example, an adhesive layer preparation step of preparing the adhesive layer 40 superposed on the surface of the support base 50, and a projection forming step of preparing the projections 12 by superposing the projection constituting member 30 on the surface of the support base 50 or the adhesive layer 40. The order in which these steps are performed is not particularly limited.

In the adhesive layer preparation step, the adhesive layer 40 can be prepared by a general method, which is not particularly limited. In the adhesive layer preparation step, the support base 50 is directly coated with an adhesive composition by a conventionally known coating means, followed by being cured or allowed to dry. The adhesive layer 40 can also be prepared on a surface having releasing properties (for example, the surface of the release liner, the back surface of the support base subjected to release treatment) by applying the adhesive composition to the above surface, and then causing the applied adhesive composition to be cured or allowed to dry. The method in which the adhesive layer 40 prepared on the surface having releasing properties is superposed on the support base 50 or the projection constituting member 30 can also be employed (transcription method).

In the adhesive layer preparation step, the adhesive layer 40 may be prepared across the entire area of one surface of the support base 50. On the other hand, the support base 50 may be provided with non-adhesive portions (dry edges) by, for example, omitting the coating both end portions in the width direction of the belt-shaped support base 50 with the adhesive composition. Typically, the continuous and layered adhesive layer 40 is prepared, but the adhesive composition may be applied into a regular pattern, such as a dotted pattern, a stripe pattern, or a grid pattern, or into a random pattern, depending on the purpose and intended use. The adhesive layer may be prepared by applying the same adhesive composition or different adhesive compositions a plurality of times. The coating method employed in the adhesive layer preparation step may be the same method as the coating method in the projection forming step, which will be described later.

In the adhesive layer preparation step, the adhesive layer 40 may be prepared by applying an adhesive composition including an uncured resin curable with energy rays, followed by curing the composition with the energy rays such as ultraviolet rays or electron beams. Specific examples of the uncured resin include an ultraviolet curing (UV curing) resin and an electron beam curing (EB curing) resin.

In the projection forming step, the projections 12 are formed by, for example, extrusion-molding the resin material molten by heat. Specifically, the resin material, which is a raw material of the projection constituting member 30, is extruded in such a manner as to draw parallel lines to prepare the line members on the support base 50 or the adhesive layer 40. The line members may also be prepared by extruding a resin composition including the resin material and at least one of wax and the aforementioned uncured resin in the same manner as aforementioned, followed by irradiating the resin composition with energy rays as appropriate.

In the projection forming step, various types of compositions are employed as the resin composition for preparing the projection constituting member 30. Examples of the composition employable include, the hot-melt type composition, the curable type composition, the water dispersible type (typically emulsion type) composition, and the solvent type composition, as aforementioned. The support base 50 may be directly coated with these resin compositions, or the adhesive layer 40 superposed on the support base 50 may be coated with these resin compositions. The coating method employable include any method including the direct coating method and the transcription method.

Examples of the coating method employable include roll coating, gravure coating, flexographic coating, kiss coating (including micro gravure coating), bar coating, comma coating, blade coating, die coating, slide coating, and curtain coating. As the coating method, die coating, gravure coating, and flexographic coating, which are excellent particularly in the coating of fine patterns, are preferable. In the coating method, the resin composition may be coated to form continuous layers, or may be coated into a regular pattern, such as a dotted pattern, a stripe pattern, or a grid pattern, or into a random and non-continuous pattern, depending on the purpose and intended use. The adhesive layer 40 and the projection constituting member 30 may each have a multi-layered structure including two or more layers. Further, foamed coating of the resin composition enables the adhesive layer 40 or the projection constituting member 30 to have cushioning properties.

In order to produce the cleaner sheet 1 at lower cost, die coating, slide coating, curtain coating, or the like can be employed to simultaneously form the adhesive layer 40 and the projection constituting member 30. The coating method for applying the compositions respectively to prepare the adhesive layer 40 and the projection constituting member 30 may be one-head coating in simultaneous multilayer coating, or one-path coating using a plurality of heads in tandem coating. The cleaner sheet 1 can be produced at low cost by preparing the adhesive layer 40 and the projection constituting member 30 by the coating method. When the projection constituting member 30 is prepared by the coating method, the projection constituting member 30 may be a continuous layer extending over the plane direction of the cleaner sheet 1, or may be a non-continuous layer having, for example, a dotted pattern. For example, a conventional cleaner sheet produced by causing a nonwoven fabric provided with openings to adhere to an adhesive layer cannot have the nonwoven fabric formed into a non-continuous layer. In contrast, in this embodiment, the coating pattern of the projection constituting member 30 can be set to achieve good slidability and dust or dirt capturing capability. Thus, any exposure ratio of the adhesive layer can be set, which cannot be achieved in the conventional cleaner sheet.

(Use of Cleaner Sheet)

The cleaner sheet 1 can be used in various sites, and for example can be used in a site where various dust or dirt, such as fine dust and coarse dust, is present. The cleaner sheet 1 captures dust or dirt with the adhesive force particularly of the adhesive recesses 14 and keeps the dust or dirt captured, and is thus excellent in capturing relatively heavyweight dust or dirt, such as sand grains, crumbs, and hairs, as compared with the conventional cleaner sheet composed only of a fiber assembly. The cleaner sheet 1 can be used with good durability not only on indoor floorings, but also on, for example, entrance floors or dirt floors on which sand grains are present, concrete surfaces on outdoor balconies or the like, and factory floors with rough, uneven surfaces subjected to slip prevention treatment. Since the cleaner sheet 1 of this embodiment can be configured to have no fiber assembly, the cleaner sheet 1 configured as above prevents fiber debris or paper dust from being generated. Thus, the cleaner sheet 1 is suitably used in, for example, clean rooms, food factories, and hospitals.

The cleaner sheet 1 may be used in the state where it is wound into a roll shape to have the cleaning surface 10 arranged on the outer side, so that it can be used as a new type adhesive roll cleaner. The conventional adhesive roll cleaner rotates only in its winding direction, and is thus used for cleaning by being rolled (moved) in such a direction. The conventional adhesive roll cleaner is therefore not maneuverable particularly in cleaning a small space. In contrast, the aforementioned new type adhesive roll cleaner can capture dust or dirt not only by rotating in the winding direction but also by sliding in a direction other than the rotating direction. The new type adhesive roll cleaner is thus maneuverable in cleaning a small space. The cleaner sheet 1 wound into a roll as aforementioned can be, for example, loosened and unwound. In this regard, an adhesive or a bond may be provided entirely or partly on the back side (the opposite side to the cleaning surface) of the cleaner sheet 1, to be able to suppress the loosening and unwinding.

(Layered Body)

The cleaner sheet 1 may be formed into a layered body by winding the cleaner sheet onto itself or by laying a plurality of the cleaner sheets on top of each other in the thickness direction. An example of the layered body is shown in, for example, FIG. 8. The layered body is fixed to the sheet fixing part 120 to perform cleaning operation with the cleaning surface 10 of the cleaner sheet 1 arranged on the outermost side, and thereafter the cleaner sheet 1 is removed so that a new, unused cleaner sheet 1 will be located on the outermost side. This configuration enables the cleaning operation to continue with the new cleaner sheet 1, without any replacement work of the cleaner sheets 1.

The matters disclosed herein include the following:

(1)

A cleaner sheet including:

a cleaning surface that is configured to be brought into sliding contact with a surface of an object to be cleaned, wherein the cleaning surface has unevenness, and includes projections respectively having distal ends configured to be in sliding contact with the object to be cleaned when in use, the projections are constituted by a member formed to have the projections arranged at intervals from each other in a plane direction of the cleaning surface, the member has a hardness of 0.4 MPa or more measured by a nano-indentation method, and the cleaning surface further includes adhesive recesses that have higher adhesive force than that of the member and are exposed on the cleaning surface.

(2)

The cleaner sheet according to (1) above, wherein a ratio (H/L) between an average projection height (H: mm) from a distal end of each of the projections to each corresponding one of the adhesive recesses and an average length (L: mm) of the adhesive recesses in a first direction in which the average length of the intervals in the plane direction becomes a minimum value is $15\times10^{-3}$ or more.

(3)

The cleaner sheet according to (2) above, wherein the ratio (H/L) is $40\times10^{-3}$ or more.

(4)

The cleaner sheet according to any of (1) to (3) above, wherein the average projection height (H: mm) from the distal end of each of the projections to each corresponding one of the adhesive recesses is $30\times10^{-3}$ mm or more.

(5)

The cleaner sheet according to any of (1) to (4) above, wherein a minimum load of a load curve obtained by measurement of the member of the projections by the nano-indentation method is −0.40 μN or more and 0 μN or less.

(6)

The cleaner sheet according to (5) above, wherein the minimum load of the load curve obtained by measurement of the member of the projections by the nano-indentation method is −0.10 μN or more and 0 μN or less.

(7)

The cleaner sheet according to any of (1) to (6) above, wherein a minimum load of an unloading curve obtained by measurement of the member of the projections by the nano-indentation method is −1.50 μN or more and 0 μN or less.

(8)

The cleaner sheet according to (7) above, wherein the minimum load of the unloading curve obtained by measurement of the member of the projections by the nano-indentation method is −0.10 μN or more and 0 μN or less.

(9)

The cleaner sheet according to any of (1) to (8) above, wherein the cleaning surface has a static friction coefficient of 1.00 or less.

(10)

The cleaner sheet according to any of (1) to (9) above, including: an adhesive layer extending in the plane direction of the cleaning surface and arranged in at least a part of the intervals of the member, wherein at least a part of the adhesive layer constitutes the adhesive recesses, and the adhesive layer has a probe tack of 500.0 $kN/m^2$ or less measured by a probe tack method.

(11)

The cleaner sheet according to (10) above, wherein the probe tack of the adhesive layer is 1.0 $kN/m^2$ or more and 500.0 $kN/m^2$ or less.

(12)

The cleaner sheet according to any of (1) to (11) above, including: an adhesive layer extending in the plane direction of the cleaning surface and arranged in at least a part of the intervals of the member, wherein at least a part of the adhesive layer constitutes the adhesive recesses, and a proportion of an exposed area of the adhesive layer in the cleaning surface is 30% or more.

(13)

The cleaner sheet according to (12) above, wherein the proportion of the exposed area of the adhesive layer in the cleaning surface is more than 50%.

(14)

The cleaner sheet according to any of (1) to (13) above, wherein the member of the projections includes at least one of wax, a cured resin, and an inorganic powder.

(15)

The cleaner sheet according to any of (1) to (14) above, wherein the member of the projections includes at least one of a polyolefin resin, an ethylene vinyl acetate copolymer resin (EVA), a styrene-based thermoplastic elastomer resin, an acrylic resin, a polyvinyl chloride resin, a polyester resin, a polyurethane resin, a polyimide resin, a polyamide resin, and a polycarbonate resin.

(16)

The cleaner sheet according to any of (1) to (15) above, wherein the member of the projections includes an extender pigment as the inorganic powder.

(17)

The cleaner sheet according to (14) above, wherein the wax included in the member of the projections has a hardness of 0.1 or more and 60 or less in penetration.

(18)

The cleaner sheet according to any one of (1) to (17) above, wherein the cleaning surface is formed on each of both sides.

(19)

A method for producing the cleaner sheet according to any one of (1) to (18), the method including: forming the member of the projections by coating.

(20)

The method for producing the cleaner sheet according to (19) above, wherein the cleaner sheet includes a support base, the method including: forming the member of the projections by being superposed on the support base by coating.

(21)

The method for producing the cleaner sheet according to (19) above, wherein the cleaner sheet includes the support base and the adhesive layer superposed on the support base, the method including: forming the member of the projections by being superposed on the adhesive layer by coating.

(22)

A layered body including: the cleaner sheet according to any of (1) to (18) above in a state of being wound onto itself, or a plurality of the cleaner sheets according to any of (1) to (18) above in a state of being laid on top of each other in a thickness direction.

(23)

A cleaning tool including: the cleaner sheet according to any of (1) to (18) above; and a sheet fixing part to which the cleaner sheet is detachably attached.

The cleaner sheet 1, the layered body, and the cleaning tool 100, of the aforementioned embodiment have been described as above, but the present invention is not limited to the cleaner sheet, the layered body and the cleaning tool described above. Various forms of the cleaner sheets and the cleaning tools generally applicable can be employed without impairing the effect of the present invention.

The cleaner sheet 1 of the above embodiment has the adhesive layer 40 supported by the support base 50, but the cleaner sheet of the present invention may be configured without a support base. For example, the cleaner sheet of the present invention may be configured without the support base but configured such that the projection constituting member 30 is arranged on both sides of the adhesive layer.

Figure 2B:
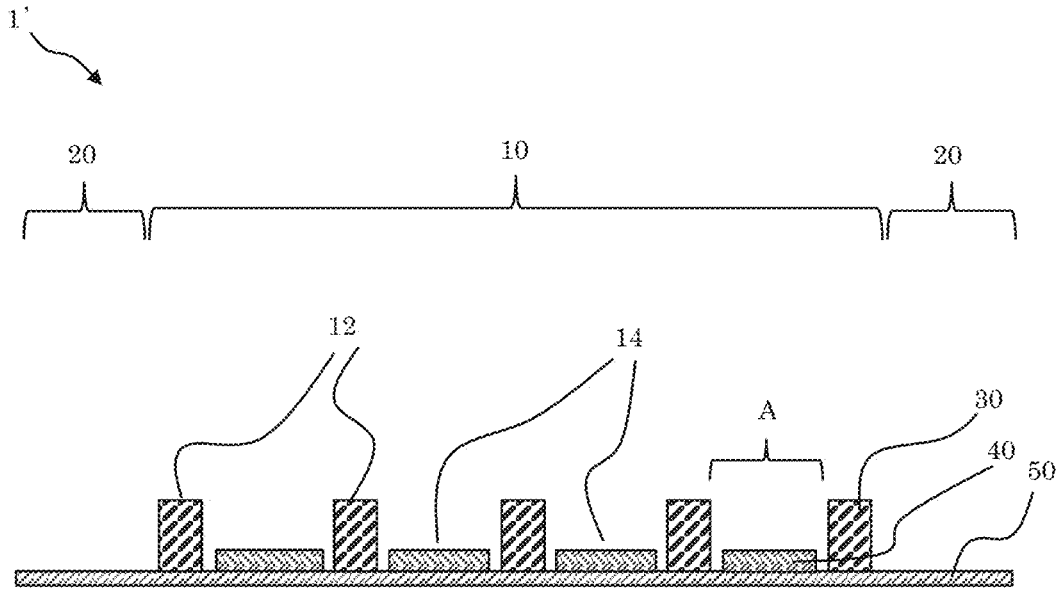
FIG. 2B is a schematic cross-sectional view of a cleaner sheet according to another embodiment taken in a thickness direction as in FIG. 2A.

The cleaner sheet 1 of the aforementioned embodiment has been described by taking, for example the case where the projection constituting member 30 is superposed on the adhesive layer 40, without limitation thereto. For example, as shown in FIG. 2B, the plurality of line members of the projection constituting member 30 may be superposed on the support base 50 while being in direct contact with the support base 50. In this case, the cleaning surface can be formed in such a manner that the plurality of line members of the projection constituting member 30 arranged at intervals from each other are superposed on the surface of the support base 50 made of, for example, a resin film or a nonwoven fabric, and thereafter the adhesive composition is put into at least a part of the intervals. In other words, the configuration may be such that no adhesive layer is arranged between the support base 50 and the projection constituting member 30. For example, the cleaning surface can be formed also by forming the plurality of line members of the projection constituting member 30 on the support base 50 by coating, and coating the adhesive layer on the intervals of the formed line members. As described above, the configuration that the projection constituting member 30 is superposed on the adhesive layer is not essential in the cleaner sheet of the present invention.

In the cleaner sheet 1 of the aforementioned embodiment, the exposed area of the adhesive recesses 14 (i.e., the exposed area of the adhesive layer 40) are substantially the same as the total area of the intervals A respectively between the plurality of line members of the projection constituting member 30. However, in the cleaner sheet of the present invention, the exposed area of the adhesive layer 40 may be smaller than the total area of the aforementioned intervals. For example, the recessed portions in the intervals do not have to be entirely occupied by the adhesive composition. The recessed portions may be partially occupied by the adhesive composition formed into a linear shape (stripe shape), or occupied by the adhesive composition formed into a dotted shape. In this case, if the support base is formed of the fiber assembly, the surface of the fiber assembly exposed on the cleaning surface can also capture dust or dirt.

In the cleaner sheet of the aforementioned embodiment, the non-cleaning surface 20 is formed on one side. However, the non-cleaning surface 20 is not necessarily formed in the cleaner sheet of the present invention. For example, the cleaning surface 10 may be formed on each of both sides of the cleaner sheet.

The cleaner sheet 1 of the aforementioned embodiment has been described by taking, for example, the case where it includes the projection constituting member 30 that is formed of the plurality of line members (linear members) having a linear shape and arranged in parallel with each other, without limitation thereto. As shown in, for example, FIG. 4, the configuration may be such that the projection constituting member continues in the plane direction of the cleaning surface 10, and that the member has holes (having, for example, a perfect circle shape or an oval shape) formed therethrough. As shown in, for example, FIG. 5, the configuration may be such that the projection constituting member is a net-like member continuously extending in the plane direction of the cleaning surface, and the adhesive layer 40 is exposed through the meshes. As shown, for example, in FIG. 6, the configuration may be such that a plurality of short line members are arranged in the longitudinal direction, the plurality of line members are adjacent to each other in a direction orthogonal to the longitudinal direction, and intervals are formed respectively between the line members both in the longitudinal direction and the orthogonal direction. Further, as shown in, for example, FIG. 7, the projection constituting member may be formed in such a manner as to draw a plurality of letters or figures. The pattern drawn with the projection constituting member 30 may be a regular pattern or an irregular pattern. For example, the pattern drawn with the projection constituting member 30 may be any pattern including, for example, a dotted pattern, a diamond pattern (a rhomboid shape), and a star pattern (a starfish shape). As the pattern drawn with the projection constituting member 30, for example, a pattern in view of dust or dirt capturing efficiency may be selected, as disclosed in JP 2011-183153 A.

The cleaning tool 100 of the aforementioned embodiment has been described by taking, for example, the case where the cleaner sheet 1 is attached to the sheet fixing part 120 located at the lower end of the long handle gripping member 110, without limitation thereto. The cleaning tool of the present invention may include a short handle (referred to also as a holder) as the gripping member. Further, the cleaning tool of the present invention may be configured to have the cleaner sheet attached to a member (sheet fixing part) having a plate shape, a spherical shape, a cylindrical shape, or the like, without such a gripping member. The cleaning tool of the present invention may include a constituting member having a soft sheet form such as cloth, or having a sponge form. Specifically, the cleaning tool of the present invention may be configured to have the aforementioned cleaner sheet fixed to a part of the soft member, and such a configuration can also exert the desired effect of the present invention. As described above, in the cleaning tool of the present invention, neither the shapes nor the materials of the gripping member, the sheet fixing member, the cleaner sheet, or the like are limited. For example, various materials such as synthetic resins, polyolefin, and polyester; synthetic fibers or natural fibers; or metals, e.g., stainless steel can be used as the constituting materials of the cleaning tool of the present invention.

Specifically, the cleaning tool 100 of the aforementioned embodiment may have the cleaner sheet 1 attached to an end portion of a long and thin rod. Such a cleaning tool 100 is used as a slidable and adhesive clearance cleaning tool. The cleaning tool 100 of the aforementioned embodiment may have the cleaner sheet 1 attached to, for example, the bottom surfaces of slippers. Such a cleaning tool 100 having the projection constituting member can be used as a product capable of cleaning while users walk, without being stuck to the floor. In these cleaning tools 100, the cleaner sheet 1 attached may be a single sheet, or may be a layered body in which a plurality of sheets are laid on top of each other.

In the cleaner sheet 1 of the aforementioned embodiment, the hardness of the projection constituting member 30 measured by the nano-indentation method is 0.4 MPa or more, but the invention disclosed herein includes, for example, the following invention (different invention) in addition to the invention of the aforementioned embodiment. The cleaner sheet according to the different invention can at least have good dust or dirt capturing capability. The cleaner sheet according to the different invention may further include the required configurations of the cleaner sheet of the aforementioned embodiment. Specifically, the different invention includes the following matters or the like:

(a) A cleaner sheet including:

a cleaning surface that is configured to be brought into sliding contact with a surface of an object to be cleaned, wherein the cleaning surface has unevenness, and includes projections respectively having distal ends configured to be in sliding contact with the object to be cleaned when in use, the projections are constituted by a member formed to have the projections arranged at intervals from each other in a plane direction of the cleaning surface, the cleaning surface further includes adhesive recesses that have higher adhesive force than that of the member and are exposed on the cleaning surface, the cleaner sheet further including: an adhesive layer extending in the plane direction of the cleaning surface and arranged in at least a part of the intervals of the member, wherein at least a part of the adhesive layer constitutes the adhesive recesses, and a proportion of an exposed area of the adhesive layer in the cleaning surface is 30% or more, and a ratio (H/L) between an average projection height (H: mm) from a distal end of each of the projections to each corresponding one of the adhesive recesses and an average length (L: mm) of the adhesive recesses in a first direction in which the average length of the intervals becomes a minimum value is $15\times10^{-3}$ or more.

(b) The cleaner sheet according to (a) above, wherein the proportion of the exposed area of the adhesive layer in the cleaning surface is more than 50%.

(c) The cleaner sheet according to (a) or (b) above, wherein the average projection height (H: mm) from the distal end of each of the projections to each corresponding one of the adhesive recesses is $1000\times10^{-3}$ mm or less.

(d) The cleaner sheet according to (c) above, wherein the average projection height (H) is $500\times10^{-3}$ mm or less.

(e) The cleaner sheet according to any of (a) to (d) above, wherein the average length (L) of the adhesive recesses in the first direction in which the average length of the intervals in the plane direction becomes a minimum value is 0.3 mm or more.

(f) The cleaner sheet according to (e) above, wherein the average length (L) is 0.5 mm or more.

(g) The cleaner sheet according to any of (a) to (f), wherein a minimum load of a load curve obtained by measurement of the member of the projections by a nano-indentation method is −0.40 μN or more and 0 μN or less.

(h) The cleaner sheet according to any of (a) to (g) above, wherein a minimum load of an unloading curve obtained by measurement of the member of the projections by the nano-indentation method is −1.50 μN or more and 0 μN or less.

(i) The cleaner sheet according to any of (a) to (h) above, wherein the cleaning surface has a static friction coefficient of 1.00 or less.

(j) The cleaner sheet according to any of (a) to (i) above, further including: an adhesive sheet extending in the plane direction of the cleaning surface and arranged on a back side of the member, a part of the adhesive surface constituting the adhesive recesses, the member has a hardness of 0.4 MPa or more measured by the nano-indentation method, and the adhesive layer has a probe tack of 25.0 kN/m$^2$ or more and 500.0 kN/m$^2$ or less measured by a probe tack method.

(k) The cleaner sheet according to any of (a) to (j) above, wherein the member of the projections includes at least one of wax, a cured resin, and an inorganic powder.

(l) The cleaner sheet according to any of (a) to (k) above, wherein the member of the projections includes at least one of a polyolefin resin, an ethylene vinyl acetate copolymer resin (EVA), a styrene-based thermoplastic elastomer resin, an acrylic resin, a polyvinyl chloride resin, a polyester resin, a polyurethane resin, a polyimide resin, a polyamide resin, and a polycarbonate resin.

(m) The cleaner sheet according to any of (a) to (l) above, wherein the member of the projections includes an extender pigment as the inorganic powder.

(n) The cleaner sheet according to (k) above, wherein the wax included in the member of the projections has a hardness of 0.1 or more and 60 or less in penetration.

(o) The cleaner sheet according to any of (a) to (n) above, having the cleaning surface formed on each of both sides.

(p) A method for producing the cleaner sheet according to any of (a) to (o), the method including: forming the member of the projections by coating.

(q) The method for producing the cleaner sheet according to (p) above, wherein the cleaner sheet includes a support base, the method including forming the member of the projections by being superposed on the support base by coating.

(r) The method for producing the cleaner sheet according to (p) above, wherein the cleaner sheet includes the support base and the adhesive layer superposed on the support base, the method including: forming the member of the projections by being superposed on the adhesive layer by coating.

(s) A layered body including: the cleaner sheet according to any of (a) to (o) above in a state of being wound onto itself, or a plurality of the cleaner sheets according to any of (a) to (o) above in a state of being laid on top of each other in a thickness direction.

(t) A cleaning tool including: the cleaner sheet according to any of (a) to (o) above; and a sheet fixing part to which the cleaner sheet is detachably attached.

Hereinafter, some Examples related to the present invention will be described, but do not intend to limit the present invention to the specific examples.

EXAMPLES

Example 1

[Preparation of Adhesive (Composition)]

The following raw materials were mixed to prepare a rubber-based adhesive (a SIS-based adhesive composition):

Base polymer: Styrene-isoprene-styrene block copolymer (SIS)

Trade name "Quintac 3520" manufactured by Zeon Corporation/100 mass parts

Tackifier: Non-hydrogenated hydrocarbon resin

Trade name "T-REZ RC093" manufactured by ENEOS Corporation/100 mass parts

Plasticizer: Naphthenic process oil

Trade name: "Diana Process Oil NS 90S" manufactured by Idemitsu Kosan Co., Ltd./100 mass parts

[Preparation of Projection Constituting Member (Composition for Projections)]

The composition of Sample 1 for the projections was prepared from the raw materials below:

Resin material: High-density polyethylene resin (HDPE)

Trade name "SHD7255LS-L" manufactured by Braskem S. A./100 mass parts

Resin material: Ethylene vinyl acetate copolymer resin (EVA)

Trade name "Ultrasen 684" manufactured by Tosoh Corporation/200 mass parts

Wax: Hydrocarbon-based

Trade name "Sasolwax C80" manufactured by Sasol Limited, penetration of about 4 to 9/450 mass parts The projections constituted by a plurality of line members (having a stripe shape) as schematically shown in FIG. 1 were formed. The cleaner sheet was formed to have a schematic shape shown in FIG. 2A.

[Production of Cleaner Sheet]

As the support base, a paper sheet having one side laminated with a polyethylene film was prepared, and the sheet was subjected to hot melt coating (simultaneous multilayer coating) with the adhesive composition and the composition for the projections obtained above, using a die coater. The adhesive composition was directly applied to a non-laminated surface which was not laminated. The thus prepared cleaner sheets of the Examples to be described later each have a structure in which the support base, the adhesive layer, and the projection constituting member are laid on top of each other in this order as shown in FIG. 2A, unless otherwise specified. The configurations of the cleaner sheets in the Examples to be described later are shown in Table 1.

Hardness of the projection constituting member (nano-indentation method) [MPa]

Elastic modulus of the projection constituting member (nano-indentation method) [MPa]

Inclination of the load curve in the nano-indentation method [μN/nm]

Minimum load of the load curve in the nano-indentation method [μN]

Minimum load of the unloading curve in the nano-indentation method [μN]

Displacement of the unloading curve in the nano-indentation method [nm]

Static friction coefficient on the cleaning surface

Dynamic friction coefficient on the cleaning surface

Thickness of the adhesive layer [μm]

Probe tack of the adhesive layer (km/m$^2$)

Exposure ratio of the adhesive layer [%]

Average length L of the adhesive recesses in the first direction [mm]

Interval A between adjacent line members [mm]

Average projection height H [mm]

Ratio (H/L) between the average projection height (H: mm) and the average length (L: mm) of the adhesive recesses Average width of the projections [mm]

Constituent of the support base

Hereinafter, the cleaner sheets configured as shown in Table 1 to Table 5 were produced. The cleaner sheets were produced basically in the same manner as in Example 1, unless otherwise specified.

Examples 2 to 8 and 11

The number of line members, the average projection height, and the like were changed as shown in Table 1 and Table 2 to produce the cleaner sheets.

Example 9

In Example 9, the cleaner sheet was produced as follows:

[Preparation of Adhesive (Composition)]

Raw materials of an acrylic adhesive (adhesive composition)

Base polymer: Acrylic triblock copolymer/100 mass parts

Details of the acrylic triblock copolymer:

Acrylic block copolymer having a triblock structure of poly[methyl methacrylate (MMA)]block-poly [2-ethylhexyl acrylate (2EHA)/n-butyl acrylate (BA)] block-poly MMA block A mass ratio between 2EHA and BA in the poly 2EHA/BA block is 50/50, and a mass ratio [(2EHA+BA)/MMA] between the poly 2EHA/BA block and the poly MMA blocks (two poly MMA blocks) is 82/18.

Mw is $10\times10^4$, Mn is $8.4\times10^4$, and Mw/Mn is 1.21

Plasticizer: Acrylic oligomer (liquid)

Trade name "ARUFON UP1021" manufactured by TOAGOSEI CO., LTD./30 mass parts

Plasticizer: Adipate-based

Trade name "Monocizer W-242" manufactured by DIC Corporation/30 mass parts

[Preparation of Projection Constituting Member (Composition for Projections)]

The composition of Sample 2 for the projections was prepared only from the raw materials below:

Resin material: Polyolefin-based elastomer (glass transition temperature of −48° C., melting peak top temperature of 47° C.)

Example 10

In Example 10, the cleaner sheet was produced as follows:

[Adhesive (Composition)]

The same composition as in Example 9 was used.

[Preparation of Projection Constituting Member (Composition for Projections)]

The composition of Sample 3 for the projections was prepared only from the raw materials below:

Resin material: Polyurethane-based elastomer (glass transition temperature of −50° C., melting peak top temperatures of 125° C. and 166° C., aromatic polyether-based urethane)

Examples 12 and 13

A polypropylene (PP) spunbond nonwoven fabric sheet (trade name "Eltas P03040" manufactured by Asahi Kasei Corp., basis weight of 40 g/m$^2$) having one side laminated with a polyethylene film (20 g/m$^2$) was used as the support base, and the adhesive composition was applied to the laminated surface side. The cleaner sheets as schematically shown in FIG. 1 and FIG. 2A were respectively formed.

Example 14

The cleaner sheet configured as shown in Table 3 was produced using the composition below as the adhesive composition, using the composition of Sample 4 below as the composition for the projections, and using the nonwoven fabric sheet described in Example 12 (but not laminated) as the support base. Both the adhesive composition and the composition for the projections were directly applied to the support base, and the projections and the adhesive layer were respectively formed into a stripe shape, as shown in FIG. 1 and FIG. 2B.

[Preparation of Adhesive (Composition)]

The following raw materials were mixed to prepare a rubber-based adhesive (a SIS-based adhesive composition):

Base polymer: Styrene-isoprene-styrene block copolymer (SIS)

Trade name "Quintac 3520" manufactured by Zeon Corporation/100 mass parts

Tackifier: Non-hydrogenated hydrocarbon resin

Trade name "T-REZ RC093" manufactured by ENEOS Corporation/130 mass parts

Plasticizer: Naphthenic process oil

Trade name: "Diana Process Oil NS 90S" manufactured by Idemitsu Kosan Co., Ltd./100 mass parts

[Preparation of Projection Constituting Member (Composition for Projections)]

The composition of Sample 4 for the projections was prepared from the raw materials below:

Resin material: Ethylene vinyl acetate copolymer resin (EVA)

Trade name "Ultrasen 684" manufactured by Tosoh Corporation/100 mass parts

Wax: Hydrocarbon-based

Trade name "Sasolwax C80" manufactured by Sasol Limited, penetration of about 4 to 9/225 mass parts Mixed raw material: Mixture of polyolefin-based resin/calcium carbonate (mass ratio of 20/80)

Trade name "CALPET A" manufactured by Nitto Funka Kogyo K.K./250 mass parts (including 200 mass parts of calcium carbonate)

The projections constituted by a plurality of line members (having a stripe shape) as schematically shown in FIG. 1 were formed. As shown in FIG. 2B, the projections were formed so that the line members directly contact the support base.

Example 15

The cleaner sheet configured as shown in Table 3 was produced using the same composition as in Example 14 as the adhesive composition, using the composition of Sample 5 below as the composition for the projections, and using the nonwoven fabric sheet described in Example 12 (but not laminated) as the support base. As shown in FIG. 1 and FIG. 2B, the projections and the adhesive layer were respectively formed into a stripe shape.

[Preparation of Projection Constituting Member (Composition for Projections)]

The composition of Sample 5 for the projections was prepared from the raw materials below:

Resin material: Linear low-density polyethylene resin (LLDPE)

Trade name "Evolue SP1071C" manufactured by Prime Polymer Co., Ltd./100 mass parts Wax: Hydrocarbon-based Trade name "Sasolwax C80" manufactured by Sasol Limited, penetration of about 4 to 9/143 mass parts Mixed raw material: Mixture of polyolefin-based resin/calcium carbonate (mass ratio of 20/80)

Trade name "CALPET A" manufactured by Nitto Funka Kogyo K.K./143 mass parts (including 114 mass parts of calcium carbonate)

Examples 16 to 18

The number of line members, the average projection height, and the like were changed as shown in Table 3 to produce the cleaner sheets.

Example 19

The cleaner sheet configured as shown in Table 3 was produced using the same composition as in Example 14 as the adhesive composition, using a polyamide resin (trade name "VESTAMELT 722GETR" manufactured by Daicel-Evonik Ltd.) as the material of Sample 6 for the projections, and using the nonwoven fabric sheet described in Example 12 (but not laminated) as the support base. As shown in FIG. 1 and FIG. 2B, the projections and the adhesive layer were respectively formed into a stripe shape.

Example 20

The cleaner sheet configured as shown in Table 4 was produced using the same composition as in Example 14 as the adhesive composition, using an ethylene vinyl acetate copolymer (EVA) (trade name "Ultrasen 684" manufactured by Tosoh Corporation) as the material of Sample 7 for the projections, and using the nonwoven fabric sheet described in Example 12 (but not laminated) as the support base. As shown in FIG. 1 and FIG. 2B, the projections and the adhesive layer were respectively formed into a stripe shape.

Examples 21 and 22

[Preparation of Adhesive (Composition)]

The following raw materials were mixed to prepare rubber-based adhesives (SIS-based adhesive compositions):

Base polymer: Styrene-isoprene-styrene block copolymer (SIS)

Trade name "Quintac 3421" manufactured by Zeon Corporation/100 mass parts

Tackifier: Non-hydrogenated hydrocarbon resin

Trade name "T-REZ RC093" manufactured by ENEOS Corporation/130 mass parts

Plasticizer: Naphthenic process oil

Trade name: "Diana Process Oil NS 90S" manufactured by Idemitsu Kosan Co., Ltd./100 mass parts The cleaner sheets configured as in Table 4 were respectively produced using the above composition as the adhesive composition, using the composition of Sample 8 below as the composition for the projections, and using the nonwoven fabric sheet described in Example 12 (but not laminated) as the support base. Both the adhesive composition and the composition for the projections were directly applied to the support base, and the projections and the adhesive layer were respectively formed into a stripe shape, as shown in FIG. 1 and FIG. 2B.

[Preparation of Projection Constituting Member (Composition for Projections)]

The composition of Sample 8 for the projections was prepared from the raw materials below:

Resin material: Linear low-density polyethylene resin (LLDPE)

Trade name "Evolue SP1071C" manufactured by Prime Polymer Co., Ltd./100 mass parts Wax: Hydrocarbon-based Trade name "Neowax" manufactured by YASUHARA CHEMICAL CO., LTD., penetration of 5/143 mass parts Mixed raw material: Mixture of polyolefin-based resin/calcium carbonate (mass ratio of 20/80)

Trade name "CALPET A" manufactured by Nitto Funka Kogyo K.K./143 mass parts (including 114 mass parts of calcium carbonate)

Examples 23 and 24

[Preparation of Adhesive (Composition)]

The following raw materials were mixed to prepare rubber-based adhesives (SIS-based adhesive compositions):

Base polymer: Styrene-isoprene-styrene block copolymer (SIS)

Trade name "Quintac 3421" manufactured by Zeon Corporation/100 mass parts

Tackifier: Non-hydrogenated hydrocarbon resin

Trade name "T-REZ RC093" manufactured by ENEOS Corporation/130 mass parts

Plasticizer: Naphthenic process oil

Trade name: "Diana Process Oil NS 90S" manufactured by Idemitsu Kosan Co., Ltd./80 mass parts The cleaner sheets configured as shown in Table 4 were respectively produced using the above composition as the adhesive composition, using the composition of Sample 8 above as the composition for the projections, and using the nonwoven fabric sheet described in Example 12 (but not laminated) as the support base. As shown in FIG. 1 and FIG. 2B, the projections and the adhesive layer were respectively formed into a stripe shape.

Comparative Examples 1 to 3

The cleaner sheets configured as shown in Table 5 were respectively produced using only a polyethylene-based elastomer (styrene-hydrogenated butylene copolymer SEBS, glass transition temperature of −16° C., melting peak top temperatures of 102 and 121° C.) as the material of Sample 9 for the projections, basically in the same manner as in Example 1.

<Physical Properties of Projection Constituting Member>

The following physical property values were measured by the nano-indentation method, as will be described below.

(Nano-Indentation Method)

The hardness and the elastic modulus of the projection constituting member by the nano-indentation method were measured according to ISO 14577. Specifically, the measurements were conducted under the following measurement conditions. The pushing depth of the indenter was 5 μm. The measurements were conducted at 25° C. At least three measurements were conducted to obtain the average value. Details of the measurement method are as follows. The cleaner sheet was cut in the thickness direction with a trimming knife to cut out the projection constituting member therefrom. The sample constituted only by the projection constituting member was used for the measurements. The sample was cut to make the cross-sectional surface by ultramicrotome under the freezing condition (−30° C.), and then was fixed to a specific support (brass table) to obtain a measurement sample.

Instrument: Nano-indenter "Triboindenter" manufactured by Hysitron

Indenter used: Berkovich type diamond indenter (trigonal pyramid-type indenter)

Measurement mode: Single pushing mode

Measurement temperature: Room temperature (25° C.)

Pushing depth: 5000 nm (5 μm)

Pushing speed: 500 nm/sec

Drawing speed: 500 nm/sec

Figure 9A:
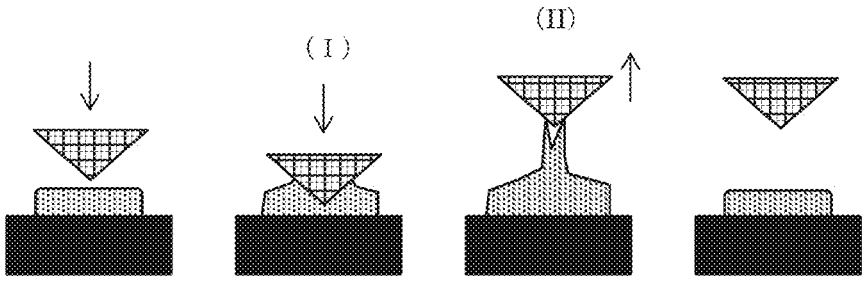
FIG. 9A is a schematic view showing a state of measurement by the nano-indentation method.
Figure 9B:
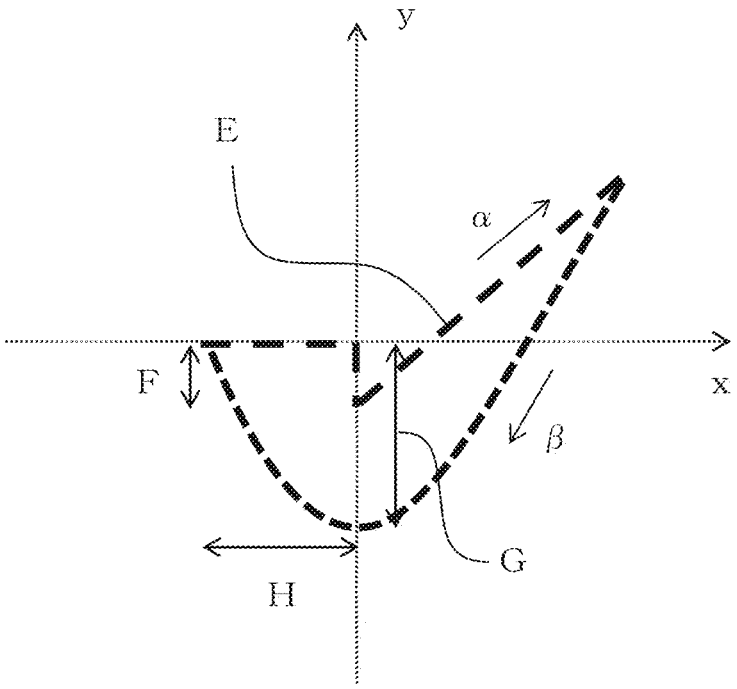
FIG. 9B is a schematic measurement chart by the nano-indentation method.

The physical property values below were calculated from the measurement results. FIG. 9A shows the state during a measurement, and FIG. 9B is a schematic measurement chart. In the schematic view of FIG. 9A, (I) shows a pushing step while (II) shows a drawing step. The horizontal axis x of the chart (graph) in FIG. 9B represents the pushing depth (displacement [nm]). The vertical axis y represents force required for pushing (load [μN]). The line a is a chart during pushing (at load), and the line B is a chart during drawing (at unloading).

"Hardness"

It was calculated by dividing the "load applied when the indenter is pushed deepest (maximum load Pmax)" by the "area in which the indenter and the measurement sample are in contact with each other (projected contact area B)"

"Elastic Modulus"

It was calculated by the aforementioned formula (3) using the "the inclination of the tangent to the unloading curve at maximum load (tangent stiffness S=dP/dh)" and the "area in which the indenter and the measurement sample are in contact with each other (projected contact area B)".

"Inclination of Load Curve [μN/Nm]"

It mainly corresponds to the compressive elastic modulus. The larger the value, the less likely deformation is to be caused by stress. It is represented by E in FIG. 9B.

"Minimum Load of Load Curve [μN]"

It is the minimum load value in the load curve. The larger the value is in the negative direction, the larger the wettability becomes. It is represented by F in FIG. 9B.

"Minimum Load of Unloading Curve [μN]"

It is the minimum load value in the unloading curve. The larger the value is in the negative direction, the greater the adsorption force (adhesive force) becomes. It is represented by G in FIG. 9B.

"Displacement of Unloading Curve [Nm]"

It is the amount of change in displacement in the unloading curve. The larger the value is in the positive direction, the higher the stringiness and the like is (when having equivalent adhesiveness). It is represented by H in FIG. 9B.

The static friction coefficient and the dynamic friction coefficient of the cleaning surface were measured for some of the cleaner sheets by the aforementioned method.

<Slidability Evaluation>

One cleaner sheet prepared by the aforementioned production method was attached to a commercially available wiper jig (Quickie Wiper body manufactured by Kao Corporation), and was used to wipe the flooring surface (Living Floor Art LVAT-MF manufactured by DAIKEN CORPORATION) to evaluate its slidability. The evaluation criteria are as follows:

4 (○○): Very good slidability 3 (○): Good slidability 2 (Δ): Resistant to floor when the sheet begins sliding, but shows good slidability when the sheet is sliding 1 (x): Strongly resistant to floor and thus not slidable, or resistant to floor when the sheet is sliding <Evaluation of Dust or Dirt Capturing Capability>

As simulated dust or dirt, 0.2 g of color sand (obtained from Factory-M; CS-1004, 0.1 to 0.5 mm) was scattered to be substantially uniformly distributed within the flooring frame having a length of 60 cm and a width of 25 cm. One cleaner sheet produced as above was attached to a commercially available wiper jig (Quickie Wiper body manufactured by Kao Corporation), and was used to wipe the flooring (Living Floor Art LVAT-MF manufactured by DAIKEN CORPORATION) by being reciprocated once in a range of 60 cm. Subsequently, further wiping was performed by reciprocating the sheet once in a range of 70 cm. Dust or dirt capturing capability (dust or dirt capturing ratio [%] on a mass basis) was calculated as follows:

Dust or dirt capturing ratio [%]=(Mass of sheet after wiping−Mass of sheet before wiping)/Amount of simulated dust or dirt scattered (about 0.2 g)×100%

TABLE 1

| | Ex. 1 | Ex. 2 | Ex. 3 | Ex. 4 | Ex. 5 | Ex. 6 |
|---|---|---|---|---|---|---|
| | Projection constituting member | | | | | |
| Sample No. | Sample. 1 | Sample. 1 | Sample. 1 | Sample. 1 | Sample. 1 | Sample. 1 |
| Hardness [MPa] | 11.4 | 11.4 | 11.4 | 11.4 | 11.4 | 11.4 |
| Elastic modulus [MPa] | 191 | 191 | 191 | 191 | 191 | 191 |
| Inclination of load curve [μN/nm] | 1.34 | 1.34 | 1.34 | 1.34 | 1.34 | 1.34 |
| Min. load of load curve [μN] | —: Substantially not wettable | —: Substantially not wettable | —: Substantially not wettable | —: Substantially not wettable | —: Substantially not wettable | —: Substantially not wettable |
| Min. load of unloading curve [μN] | —: Substantially not adsorptive | —: Substantially not adsorptive | —: Substantially not adsorptive | —: Substantially not adsorptive | —: Substantially not adsorptive | —: Substantially not adsorptive |
| Displacement of unloading curve [nm] | —: Substantially not stringy | —: Substantially not stringy | —: Substantially not stringy | —: Substantially not stringy | —: Substantially not stringy | —: Substantially not stringy |
| Statistic friction coefficient of cleaning surface | Not measured | Not measured | Not measured | 0.433 | Not measured | Not measured |
| Dynamic friction coefficient of cleaning surface | Not measured | Not measured | Not measured | 0.178 | Not measured | Not measured |

TABLE 1-continued

| | Ex. 1 | Ex. 2 | Ex. 3 | Ex. 4 | Ex. 5 | Ex. 6 |
|---|---|---|---|---|---|---|
| | | | Adhesive layer | | | |
| Thickness of adhesive layer [μm] | 25 | 25 | 25 | 25 | 25 | 25 |
| Probe tack of adhesive layer [kN/m$^2$] | 133.0 | 133.0 | 133.0 | 133.0 | 133.0 | 133.0 |
| Exposure ratio of adhesive layer [%] | 74.2 | 74.2 | 82.6 | 82.6 | 87.9 | 87.9 |
| Ave. length of adhesive recess: L [mm] | 1.00 | 1.00 | 1.65 | 1.65 | 2.50 | 2.50 |
| Interval A [mm] | As above | As above | As above | As above | As above | As above |
| No. of projection stripes | 110 | 110 | 74 | 74 | 52 | 52 |
| Ave. projection height: H × $10^{-3}$ [mm] | 60 | 160 | 70 | 160 | 100 | 160 |
| Ave. projection width [mm] | 0.35 | 0.35 | 0.35 | 0.35 | 0.35 | 0.35 |
| Ratio (H/L) × $10^{-3}$ | 60.0 | 160.0 | 42.4 | 97.0 | 40.0 | 64.0 |
| Support base constituent | Paper sheet | Paper sheet | Paper sheet | Paper sheet | Paper sheet | Paper sheet |
| Slidability | 4 (○○) | 4 (○○) | 4 (○○) | 4 (○○) | 4 (○○) | 4 (○○) |
| Dust or dirt capturing capability [%] | 82.1 | 85.4 | 86.6 | 75.6 | 78.2 | 84.7 |

25

TABLE 2

| | Ex. 7 | Ex. 8 | Ex. 9 | Ex. 10 | Ex. 11 | Ex. 12 | Ex. 13 |
|---|---|---|---|---|---|---|---|
| | | | Projection constituting member | | | | |
| Sample No. | Sample. 1 | Sample. 1 | Sample. 2 | Sample. 3 | Sample. 1 | Sample. 1 | Sample. 1 |
| Hardness [MPa] | 11.4 | 11.4 | 3.33 | 1.51 | 11.4 | 11.4 | 11.4 |
| Elastic modulus [MPa] | 191 | 191 | 25.5 | 14.6 | 191 | 191 | 191 |
| Inclination of load curve [μN/nm] | 1.34 | 1.34 | 0.269 | 0.143 | 1.34 | 1.34 | 1.34 |
| Min. load of load curve [μN] | —: Substantially not wettable | —: Substantially not wettable | —: Substantially not wettable | −0.328 | —: Substantially not wettable | —: Substantially not wettable | —: Substantially not wettable |
| Min. load of unloading curve [μN] | —: Substantially not adsorptive | —: Substantially not adsorptive | —: Substantially not adsorptive | −1.28 | —: Substantially not adsorptive | —: Substantially not adsorptive | —: Substantially not adsorptive |
| Displacement of unloading curve [nm] | —: Substantially not stringy | —: Substantially not stingy | —: Substantially not stringy | —: Substantially not stringy | —: Substantially not stringy | —: Substantially not stringy | —: Substantially not stringy |
| Statistic friction coefficient of cleaning surface | Nd measured | Not measured | 0.707 | Not measured | Not measured | Not measured | Not measured |
| Dynamic friction coefficient of cleaning surface | Not measured | Not measured | 0.914 | Not measured | Not measured | Not measured | Not measured |
| | | | Adhesive layer | | | | |
| Thickness of adhesive layer [μm] | 25 | 25 | 25 | 25 | 25 | 25 | 25 |
| Probe tack of adhesive layer [kN/m$^2$] | 133.0 | 133.0 | 65.1 | 65.1 | 133.0 | 133.0 | 133.0 |
| Exposure ratio of adhesive layer [%] | 91.5 | 91.5 | 82.6 | 82.6 | 91.5 | 82.6 | 82.6 |
| Ave. length of adhesive recess: L [mm] | 3.65 | 3.65 | 1.65 | 1.65 | 3.65 | 1.65 | 1.65 |
| Interval A [mm] | As above | As above | As above | As above | As above | As above | As above |
| No. of projection stripes | 37 | 37 | 74 | 74 | 37 | 74 | 74 |
| Ave. projection height: H × $10^{-3}$ [mm] | 160 | 320 | 160 | 160 | 100 | 250 | 400 |
| Ave. projection width [mm] | 0.35 | 0.35 | 0.35 | 0.35 | 0.35 | 0.35 | 0.35 |

TABLE 2-continued

| | Ex. 7 | Ex. 8 | Ex. 9 | Ex. 10 | Ex. 11 | Ex. 12 | Ex. 13 |
|---|---|---|---|---|---|---|---|
| Ratio (H/L) × $10^{-3}$ | 43.8 | 87.6 | 96.9 | 96.9 | 27.4 | 151.5 | 242.4 |
| Support base constituent | Paper sheet | Paper sheet | Paper sheet | Paper sheet | Paper sheet | Nonwoven fabric sheet | Nonwoven fabric sheet |
| Slidability | 4 (○○) | 4 (○○) | 3 (○) | 2 (Δ) | 3 (○) | 4 (○○) | 4 (○○) |
| Dust or dirt capturing capability [%] | 85.7 | 84.5 | 74.0 | 78.1 | 87.1 | 89.3 | 83.2 |

TABLE 3

| | Ex. 14 | Ex. 15 | Ex. 16 | Ex. 17 | Ex. 18 | Ex. 19 |
|---|---|---|---|---|---|---|
| Projection constituting member | | | | | | |
| Sample No. | Sample. 4 | Sample. 5 | Sample 5 | Sample 5 | Sample 5 | Sample 6 |
| Hardness [MPa] | 17.2 | 25.1 | 25.1 | 25.1 | 25.1 | 30.6 |
| Elastic modulus [MPa] | 316 | 491 | 491 | 491 | 491 | 342 |
| Inclination of load curve [μN/nm] | 2.10 | 3.15 | 3.15 | 3.15 | 3.15 | 2.98 |
| Min. load of load curve [μN] | —: Substantially not wettable | —: Substantially not wettable | —: Substantially not wettable | —: Substantially not wettable | —: Substantially not wettable | —: Substantially not wettable |
| Min. load of unloading curve [μN] | —: Substantially not adsorptive | —: Substantially not adsorptive | —: Substantially not adsorptive | —: Substantially not adsorptive | —: Substantially not adsorptive | —: Substantially not adsorptive |
| Displacement of unloading curve [nm] | —: Substantially not stringy | —: Substantially not stringy | —: Substantially not stringy | —: Substantially not stringy | —: Substantially not stringy | —: Substantially not stringy |
| Statistic friction coefficient of cleaning surface | Not measured | Not measured | Not measured | Not measured | Not measured | Not measured |
| Dynamic friction coefficient of cleaning surface | Not measured | Not measured | Not measured | Not measured | Not measured | Not measured |
| Adhesive layer | | | | | | |
| Thickness of adhesive layer [μm] | 25 | 10 | 25 | 25 | 25 | 25 |
| Probe tack of adhesive layer [kN/$m^2$] | 41.1 | 41.1 | 42.1 | 44.1 | 47.9 | 41.1 |
| Exposure ratio of adhesive layer [%] | 65.2 | 65.2 | 65.2 | 70.3 | 80.9 | 65.2 |
| Ave. length of adhesive recess: L [mm] | 1.30 | 1.30 | 1.30 | 2.00 | 2.30 | 1.30 |
| Interval A [mm] | 1.65 | 1.65 | 1.65 | 2.50 | 2.50 | 1.65 |
| No. of projection stripes | 74 | 74 | 74 | 52 | 52 | 74 |
| Ave. projection height: H × $10^{-3}$ [mm] | 160 | 150 | 140 | 70 | 90 | 160 |
| Ave. projection width [mm] | 0.35 | 0.35 | 0.35 | 0.35 | 0.35 | 0.35 |
| Ratio (H/L) × $10^{-3}$ | 123.1 | 115.4 | 107.7 | 35.0 | 39.1 | 123.1 |
| Support base constituent | Nonwoven fabric sheet | Nonwoven fabric sheet | Nonwoven fabric sheet | Nonwoven fabric sheet | Nonwoven fabric sheet | Nonwoven fabric sheet |
| Slidability | 4 (○○) | 4 (○○) | 4 (○○) | 3 (○) | 3 (○) | 4 (○○) |
| Dust or dirt capturing capability [%] | 88.2 | 96.3 | 94.6 | 77.5 | 100.0 | 89.2 |

TABLE 4

| | Ex. 20 | Ex. 21 | Ex. 22 | Ex. 23 | Ex. 24 |
|---|---|---|---|---|---|
| Projection constituting member | | | | | |
| Sample No. | Sample. 7 | Sample. 8 | Sample. 8 | Sample. 8 | Sample. 8 |
| Hardness [MPa] | 4.06 | 36.3 | 36.3 | 36.3 | 36.3 |
| Elastic modulus [MPa] | 32.9 | 846 | 846 | 846 | 846 |

TABLE 4-continued

| | Ex. 20 | Ex. 21 | Ex. 22 | Ex. 23 | Ex. 24 |
|---|---|---|---|---|---|
| Inclination of load curve [μN/nm] | 0.340 | 4.57 | 4.57 | 4.57 | 4.57 |
| Min. load of load curve [μN] | —: Substantially not wettable | —: Substantially not wettable | —: Substantially not wettable | —: Substantially not wettable | —: Substantially not wettable |
| Min. load of unloading curve [μN] | —: Substantially not adsorptive | —: Substantially not adsorptive | —: Substantially not adsorptive | —: Substantially not adsorptive | —: Substantially not adsorptive |
| Displacement of unloading curve [nm] | —: Substantially not stringy | —: Substantially not stringy | —: Substantially not stringy | —: Substantially not stringy | —: Substantially not stringy |
| Statistic friction coefficient of cleaning surface | Not measured | Not measured | Not measured | Not measured | Not measured |
| Dynamic friction coefficient of cleaning surface | Not measured | Not measured | Not measured | Not measured | Not measured |
| Adhesive layer | | | | | |
| Thickness of adhesive layer [μm] | 25 | 10 | 20 | 10 | 20 |
| Probe tack of adhesive layer [kN/m$^2$] | 41.1 | 43.6 | 40.4 | 7.0 | 10.1 |
| Exposure ratio of adhesive layer [%] | 65.2 | 65.2 | 65.2 | 65.2 | 65.2 |
| Ave. length of adhesive recess: L [mm] | 1.30 | 1.30 | 1.30 | 1.30 | 1.30 |
| Interval A [mm] | 1.65 | 1.65 | 1.65 | 1.65 | 1.65 |
| No. of projection stripes | 74 | 74 | 74 | 74 | 74 |
| Ave. projection height: H × $10^{-3}$ [mm] | 160 | 140 | 150 | 80 | 100 |
| Ave. projection width [mm] | 0.35 | 0.35 | 0.35 | 0.35 | 0.35 |
| Ratio (H/L) × $10^{-3}$ | 123.1 | 107.7 | 115.4 | 61.5 | 76.9 |
| Support base constituent | Nonwoven fabric sheet | Nonwoven fabric sheet | Nonwoven fabric sheet | Nonwoven fabric sheet | Nonwoven fabric sheet |
| Slidability | 3 (○) | 4 (○○) | 4 (○○) | 4 (○○) | 4 (○○) |
| Dust or dirt capturing capability [%] | 80.8 | 90.3 | 95.8 | 90.3 | 94.5 |

TABLE 5

| | C. Ex. 1 | C. Ex. 2 | C. Ex. 3 |
|---|---|---|---|
| Projection constituting member | | | |
| Sample No. | Sample. 9 | Sample. 9 | Sample. 9 |
| Hardness [MPa] | 0.38 | 0.38 | 0.38 |
| Elastic modulus [MPa] | 4.29 | 4.29 | 4.29 |
| Inclination of load curve [μN/nm] | 0.0387 | 0.0387 | 0.0387 |
| Min. load of load curve [μN] | −0.592 | −0.592 | −0.592 |
| Min. load of unloading curve [μN] | −2.44 | −2.44 | −2.44 |
| Displacement of unloading curve [nm] | —: Substantially not stringy | —: Substantially not stringy | —: Substantially not stringy |
| Statistic friction coefficient of cleaning surface | Not measured | Not measured | Not measured |
| Dynamic friction coefficient of cleaning surface | Not measured | Not measured | Not measured |
| Adhesive layer | | | |
| Thickness of adhesive layer [μm] | 25 | 25 | 25 |
| Probe tack of adhesive layer [kN/m$^2$] | 133.0 | 133.0 | 133.0 |
| Exposure ratio of adhesive layer [%] | 91.5 | 82.6 | 17.5 |
| Ave. length of adhesive recess: L [mm] | 3.65 | 1.65 | 0.35 |
| Interval A [mm] | As above | As above | As above |
| No. of projection stripes | 37 | 74 | 74 |
| Ave. projection height: H × $10^{-3}$ [mm] | 30 | 20 | 20 |
| Ave. projection width [mm] | 0.35 | 0.35 | 1.65 |
| Ratio (H/L) × $10^{-3}$ | 8.22 | 12.1 | 57.1 |
| Support base constituent | Paper sheet | Paper sheet | Paper sheet |
| Slidability | 1 (x) | 1 (x) | 1 (x) |
| Dust or dirt capturing capability [%] | 0% | 0% | 9% |

As shown in Table 1 to Table 4, the cleaner sheet according to each of the Examples, in which the hardness (by the nano-indentation method) of the projection constituting member is 0.4 MPa or more, exhibited good slidability and moreover exhibited good dust or dirt capturing capability. On the other hand, as shown in Table 5, the cleaner sheet according to each of the Comparative Examples, in which the hardness of the projection constituting member is less than 0.4 MPa, exhibited at least poorer slidability than that of the Examples.

As can be understood from the results above, the cleaner sheet in which the cleaning surface has unevenness, the adhesive recesses (adhesive layer) are exposed respectively between adjacent projections, and the hardness (by the nano-indentation method) of the projection constituting member is 0.4 MPa or more, has good slidability.

INDUSTRIAL APPLICABILITY

The cleaner sheet, the layered body of the cleaner sheet, and the cleaning tool of the present invention are suitably used for cleaning, for example, a floor. Specifically, the cleaner sheet, the layered body of the cleaner sheet, and the cleaning tool of the present invention can be suitably used for removing dust or dirt not only on flat surfaces such as indoor and outdoor floors, but also on rough surfaces such as concrete surfaces with great unevenness.

REFERENCE SIGNS LIST

1: Cleaner sheet
10: Cleaning surface
12: Projection
14: Adhesive recess
20: Non-cleaning surface
30: Projection constituting member
40: Adhesive layer
50: Support base
A: Interval
100: Cleaning tool
110: Gripping member
120: Sheet fixing part
130: Universal joint
140: Radial slit

The invention claimed is:

1. A cleaner sheet comprising:
a cleaning surface that is configured to be brought into sliding contact with a surface of an object to be cleaned, wherein
the cleaning surface has unevenness, and comprises projections respectively having distal ends configured to be in sliding contact with the object to be cleaned when in use,
the projections are constituted by a member formed to have the projections arranged at intervals from each other in a plane direction of the cleaning surface,
the cleaning surface further comprises adhesive recesses that have higher adhesive force than that of the member and are exposed on the cleaning surface,
the cleaner sheet further comprising: an adhesive layer extending in the plane direction of the cleaning surface and arranged in at least a part of the intervals of the member, wherein
at least a part of the adhesive layer constitutes the adhesive recesses,
a proportion of an exposed area of the adhesive layer in the cleaning surface is 30% or more,
a ratio (H/L) between an average projection height (H: mm) from a distal end of each of the projections to each corresponding one of the adhesive recesses and an average length (L:
mm) of the adhesive recesses in a first direction in which the average length of the intervals in the plane direction becomes a minimum value is $15\times10^{-3}$ or more, and
the average projection height (H) from the distal end of each of the projections to each corresponding one of the adhesive recesses is 1 mm or less, and the member of the projections comprises at least one of wax, an ethylene vinyl acetate copolymer resin (EVA), and polycarbonate resin.

2. The clear sheet according to claim 1, wherein
the proportion of the exposed area of the adhesive layer in the cleaning surface is more than 50%.

3. The cleaner sheet according to claim 1 wherein the average projection height (H) is 0.5 mm or less.

4. The cleaner sheet according to claim 1, wherein
the average length (L) of the adhesive recesses in the first direction in which the average length of the intervals in the plane direction is 0.3 mm or more.

5. The cleaner sheet according to claim 4, wherein the average length (L) is 0.5 mm or more.

6. The cleaner sheet according to claim 1, wherein
a minimum load of a load curve obtained by measurement of the member of the projections by a nano-indentation method is −0.40 μN or more and 0 μN or less.

7. The cleaner sheet according to claim 1, wherein
a minimum load of an unloading curve obtained by measurement of the member of the projections by the nano-indentation method is −1.50 μN or more and 0 μN or less.

8. The cleaner sheet according to claim 1, wherein the cleaning surface has a static friction coefficient of 1.00 or less.

9. The cleaner sheet according to claim 1, further comprising:
an adhesive layer extending in the plane direction of the cleaning surface and arranged on a back side of the member, a part of the adhesive layer constituting the adhesive recesses, wherein
the member has a hardness of 0.4 MPa or more measured by a nano-indentation method, and
the adhesive layer has a probe tack of 25.0 $kN/m^2$ or more and 500.0 $kN/m^2$ or less measured by a probe tack method.

10. The cleaner sheet according to claim 1, wherein
the member of the projections comprises wax.

11. The cleaner sheet according to claim 1, wherein
the member of the projections comprises at least one of an ethylene vinyl acetate copolymer resin (EVA) and a polycarbonate resin.

12. The cleaner sheet according to claim 1, wherein
the member of the projections comprises a wax, and
the wax included in the member of the projections has a hardness of 0.1 or more and 60 or less in penetration.

13. The cleaner sheet according to claim 1, wherein the cleaning surface is formed on each of both sides.

14. A method for producing the cleaner sheet according to claim 1, the method comprising:
forming the member of the projections by coating.

15. The method for producing the cleaner sheet according to claim 14, wherein
the cleaner sheet comprises a support base,
the method comprising: forming the member of the projections by being superposed on the support base by coating.

16. The method for producing the cleaner sheet according to claim 14, wherein
the cleaner sheet comprises the support base and the adhesive layer superposed on the support base,
the method comprising: forming the member of the projections by being superposed on the adhesive layer by coating.

17. A layered body comprising:
the cleaner sheet according to claim 1 in a state of being wound onto itself, or
a plurality of the cleaner sheets according to claim 1 in a state of being laid on top of each other in a thickness direction.

18. A cleaning tool comprising:

the cleaner sheet according to claim 1; and a sheet fixing part to which the cleaner sheet is detachably attached.

* * * * *